United States Patent [19]

Hannah

[11] Patent Number: 4,771,279

[45] Date of Patent: Sep. 13, 1988

[54] DUAL CLOCK SHIFT REGISTER

[75] Inventor: Marc R. Hannah, Menlo Park, Calif.

[73] Assignee: Silicon Graphics, Inc., Mountain View, Calif.

[21] Appl. No.: 71,985

[22] Filed: Jul. 10, 1987

[51] Int. Cl.[4] ..... G09G 3/00

[52] U.S. Cl. ..... 340/801; 340/800; 340/728; 358/140; 377/54; 377/67

[58] Field of Search ..... 340/801, 800, 725, 728, 340/731, 735, 709, 728; 358/22, 138, 93, 140, 183, 280; 397/64, 67, 54; 328/63, 72, 60; 382/41, 47

[56] References Cited

U.S. PATENT DOCUMENTS

| | | | |
|---|---|---|---|
| 2,921,124 | 1/1960 | Graham | 358/138 |
| 3,868,673 | 2/1975 | Mau, Jr. et al. | 340/709 |
| 4,242,678 | 12/1980 | Somerville | 340/728 |
| 4,288,821 | 9/1981 | Lavallee et al. | 358/280 |
| 4,308,532 | 12/1981 | Murphy | 340/728 |
| 4,395,764 | 7/1983 | Matsue | 377/67 |
| 4,530,107 | 7/1985 | Williams | 377/54 |
| 4,531,152 | 7/1985 | Lemelson et al. | 358/141 |
| 4,567,515 | 1/1986 | Schumacher | 358/93 |
| 4,630,294 | 12/1986 | Willis | 377/64 |
| 4,633,242 | 12/1986 | Sekiya | 340/711 |
| 4,652,908 | 3/1987 | Fling et al. | 358/183 |
| 4,665,433 | 5/1987 | Hinson et al. | 358/22 |
| 4,684,935 | 8/1987 | Brown et al. | 358/140 |
| 4,719,375 | 1/1988 | Martin | 328/63 |
| 4,719,509 | 1/1988 | Sakamoto | 358/140 |

*Primary Examiner*—Marshall M. Curtis
*Assistant Examiner*—Mahmoud Fatahi-Yar
*Attorney, Agent, or Firm*—Blakely, Sokoloff, Taylor & Zafman

[57] ABSTRACT

A dual clock shift register for use in a computer display system for converting a higher resolution image for a computer screen to a lower resolution image for display on a lower resolution display apparatus. The dual clock shift register includes a first shift register which is used to apportion a second shift register between control by two different clock rates.

6 Claims, 10 Drawing Sheets

1ST SCAN LINE
2ND SCAN LINE
3RD SCAN LINE
PORTION OF 1ST THREE SCAN LINES OF HIGH RESOLUTION (1280 x 960) IMAGE
1280 PIXEL COLUMNS
101
102
P1
P2
P3
WEIGHTING FACTOR FOR PARTICULAR PIXEL
960 ROWS (SCAN LINES)

PORTION OF 1ST SCAN LINE RESULTING FROM 3x3 → 1 AVERAGING OF 1280 x 960 IMAGE TO 640 x 480 IMAGE
640 PIXEL COLUMNS
480 ROWS

FIG. 4a
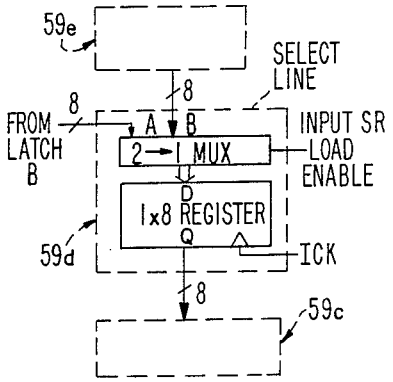
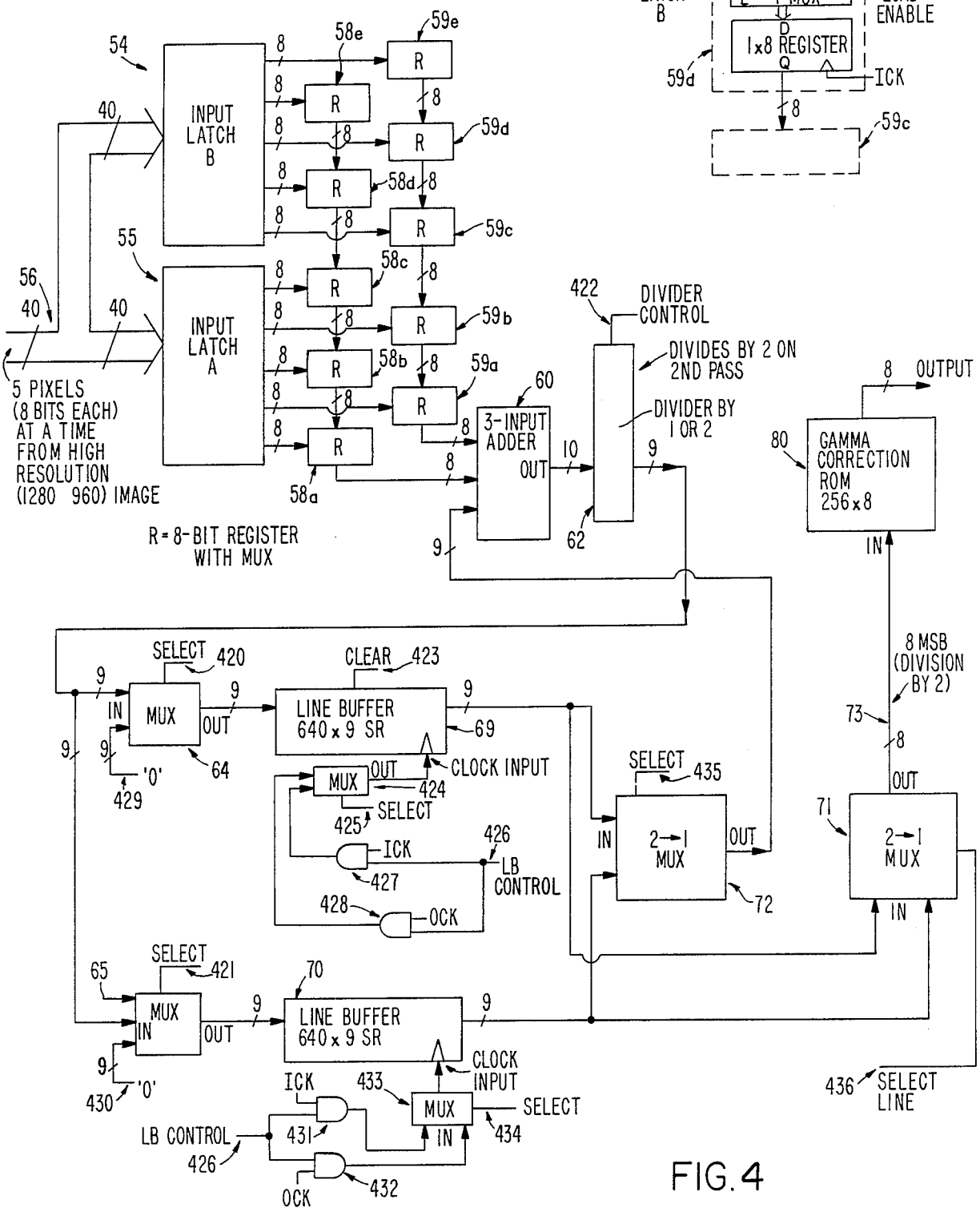
FIG. 4

2x2 → 1 AVERAGING
(A1)
(A2)
(B1)
(B2)
1 2 3 4 5 6 7 8 9 10 11 12 13 14 15 16 17 18 19 20
1ST SCAN LINE OF HIGH RESOLUTION IMAGE
A
B
3 7 11 15 19 23 27
1ST PASS PIXEL VALUES BASED ON 1ST SCAN LINE OF HIGH RESOLUTION IMAGE

2x2 → 1 AVERAGING (2ND PASS)
(A1)
(A2)
(B1)
(B2)
101 102 103 104 105 106 107 108 109 110 111 112 113 114 115 116 117 118 119 120
2ND SCAN LINE (HI-RES.)
(PRIOR TO ANY DIVISION)
A
B
206 214 222 230 238 246 254
2ND PASS PIXEL VALUES BASED ON 2ND SCAN LINE (FIG.6) & 1ST SCAN LINE (OF FIG.5)

DUAL CLOCK SR 7 AT BEGINNING OF A 3RD PASS

RELATIVE HORIZONTAL SYNCHRONIZED TIMING

HIGH RESOLUTION (HI-RES.) IMAGE: 1280 x 960
LOW RESOLUTION (LO-RES.) IMAGE: 640 x 480

VIDEO PROCESSING SEQUENCE (STATES)

INPUT SECTION TIMING

FINITE STATE MACHINE

STATE MACHINE PROCESSING (2x2 AVERAGING)

DUAL CLOCK SHIFT REGISTER

BACKGROUND OF THE INVENTION

The invention relates generally to computer systems for converting a higher resolution image to a lower resolution image for display on a computer display apparatus generally of the cathode-ray tube type or other types of display apparatuses (e.g. liquid crystal display). More specifically, the invention relates to a system utilizing weighted averaging of pixel values to convert from a higher resolution image to a lower resolution image.

Computer systems are capable of displaying graphics using pixels, which are dots generated on a video screen, such as a computer monitor. A typical computer usually has one output which can generate an image of a certain resolution (e.g. 512×256). This video technology is well known and described in various textbooks and references including *Raster Graphics Handbook*, produced by Conrac Division, Conrac Corporation, (ISBN: 0-9604972-0-X; Library of Congress Catalog No.: 80-69450). Often, a computer has a video output, which can provide a higher resolution image and a lower resolution image. However, the lower resolution image is independently created and is not derived from or converted from the higher resolution image.

The present invention provides for a means (e.g. a pixel averaging means) for converting from the high resolution image to the low resolution image and thus avoids the need for independent methods of creating the lower resolution image.

The present invention includes a special memory means which is a dual clock shift register; this memory means allows for the outputting of the converted (lower) resolution image at a different clock rate than the input of the high resolution image into the conversion system which converts between the high and low resolution images.

In a typical computer system which displays graphics, the pixel values are stored in an image memory which is a bit map of the screen, as is well known in the prior art. The pixel values are read out from the image memory, such as a "frame buffer", to produce the image on the screen. The pixels are typically integers represented by digital values from 0 to an upper limit, for example, 255. As is well known in the art, the digital values are converted to analog signals through digital to analog conversion circuitry, which are used to generate the image. Thus, for example, a pixel having a value of 0 is completely dark while a pixel having a value of 255 produces the brightest possible spot on the screen at the location of the pixel. If the display is an RGB (Red-Green-Blue) color display, each of the three components, red, green and blue, has its own pixel value to indicate the intensity of the particular component. Thus, for example, if the component is the red (R) component then the pixel value 255, in the present example, would be the reddest red possible. If the pixel averaging system of the invention is used with an RGB color display, there will be three pixel averaging means, each of which averages one of the three color components.

It is an object of the present invention to provide a system and process for converting the pixels in a high resolution image to pixel values in a lower resolution image through a pixel averaging means which calculates and outputs weighted averages based on the pixels in the high resolution image.

It is a further object of the invention to provide a way to view a high resolution image on a lower resolution monitor or screen by averaging pixels in the high resolution image. Moreover, it is an object of the invention to provide a system and architecture for averaging the pixels from the high resolution image to the lower resolution image. Moreover, it is an object of the invention to provide a system and architecture for averaging the pixels on a single integrated circuit (IC) chip for each component in a RGB color system.

Furthermore it is an object of the invention to provide a system and architecture for averaging a 3×3 group of pixels to a single pixel in a low resolution image. It is also an object to provide a system and architecture to average a group of 2×2 pixels to a single pixel for display on a low resolution screen.

It is also an object of the invention to provide a memory means in the form of a dual clock shift register which can output information for the low resolution image at a different clock rate than the clock rate at which it receives converted pixel values.

SUMMARY OF THE INVENTION

The present invention involves a dual clock shift register which is a memory means for storing information which must be accessed sequentially at two different clock rates. The dual clock shift register may be used in a computer display system for converting a high resolution image for a computer screen to a lower resolution image for display on a lower resolution display apparatus. In such computer display systems it is common that there is a first clock rate and a second clock rate which are often related to the input and output of data from that system.

The dual clock shift register has three main components the first of which is a shift register having n 1 bit stages. This first shift register is used to shift a first logical state, such as a 1, through the shift register under the control of the second clock rate. A clear signal is applied to each of the registers to clear all registers of the first shift register to a particular logical state so that the dual clock shift register may be initialized.

The second component of the dual clock shift register includes a group of n multiplexers each of which is associated with one of the registers in the first shift register such that the output of the first register in the first shift register is coupled to the select line of the first multiplexer in the group of n multiplexers. Each of the multiplexers in the group of n multiplexers has two inputs, one for the first clock rate and the second for the second clock rate such that the select line selects between the two different clock rates which are applied to the clock rate signals of registers in a second shift register having m registers, where m is equal to n.

The first shift register effectively controls the allocation of the two different clock rates among the registers in the second shift register, whereby a portion of the second shift register may be clocked at a different rate than the other portion of that second shift register.

DESCRIPTION OF THE DRAWINGS

FIG. 4 shows a system for averaging a 2×2 group of pixels to a single pixel.

DESCRIPTION OF THE INVENTION

The system of the present invention will convert digital values representing a group of pixels on a high resolution image to an average pixel value (or smaller group of pixels) for display on a lower resolution image. Computer screens are catagorized by the number of pixel columns and pixel rows (scan lines) which they can display. For example, a "1280×960" screen can display 1280 columns of pixels and 960 scan lines. The system of the invention takes an area of the high resolution screen and, utilizing the digital values of the pixels in that area, calculates an average based on the pixels in that area to produce a pixel for display on the lower resolution screen.

Figure 1:
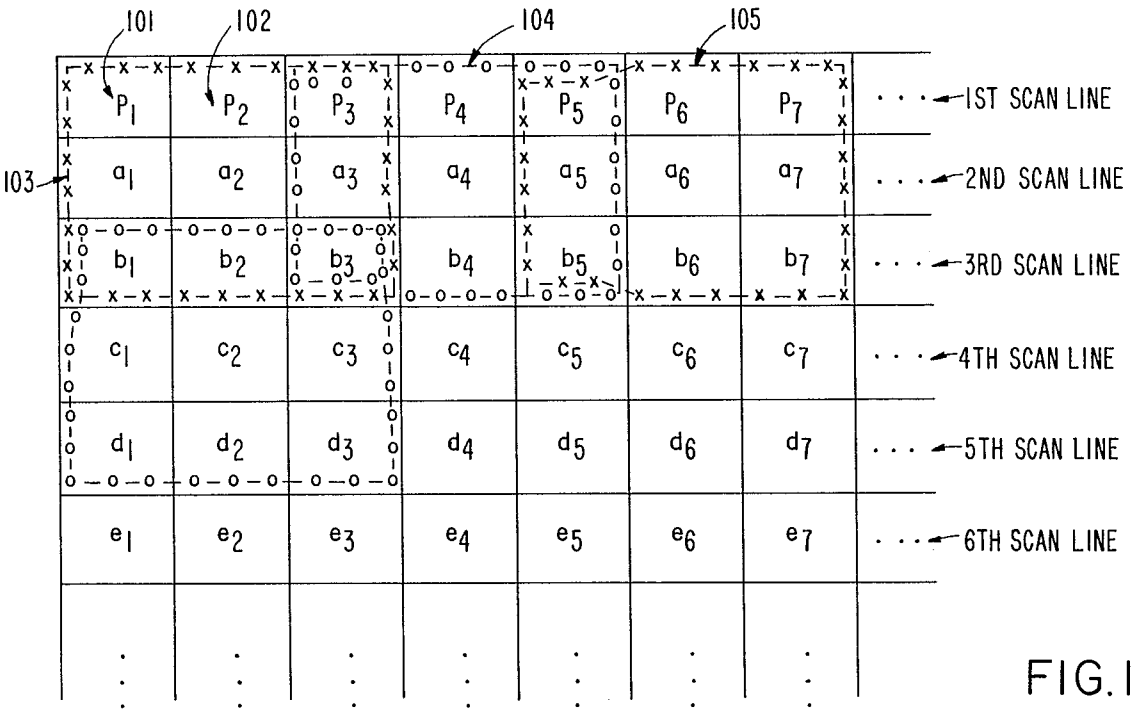
FIG. 1 shows a schematic representation of a computer screen in a graphic display mode where each rectangular subunit ("quadrant") is for a single pixel.

FIG. 1 shows a computer screen which has been sectioned into quadrants (rectangular subunits) to illustrate the various locations of pixels and scan lines. The first scan line includes pixels P1, P2, P3, P4, P5, P6 and P7. Pixel 101, which is also shown as pixel P1, is the first pixel of the first scan line. Pixel 102, which is also shown as P2, is the second pixel of the first scan line. Pixels 102 and 101 will be part of the average of the 3×3 ("3 by 3") group of pixels referred to by the numeral 103. The area 103 defines a nine pixel group (which is 3×3) having three rows and three columns. That group of pixels (area 103) includes pixels P1, P2, P3, and a1, a2 and a3, and b1, b2 and b3. Similarly, area 104 defines a 3×3 group of pixels comprising P3, P4, P5, a3, a4, a5 and b3, B4 and b5. It can be seen that the 3×3 group of pixels defined by the area 105 of FIG. 1 includes pixels P5, P6, P7, a5, a6, a7, b5, b6 and b7. In the preferred embodiment of the invention which averages the 3×3 group of pixels into a single pixel for display on the lower resolution image, the areas 103, 104 and 105 would each be converted into one pixel thus converting areas 103, 104 and 105 into a row of three pixels in the first scan line of lower resolution image.

The system of the invention performs the averaging by processing one line at a time, which is referred to as a "pass." In the example which is described next, the first scan line is processed in the first pass and the second scan line is processed in the second pass. The conversion of a 3×3 group of pixels to a single pixel involves three passes to produce the average values in the converted (lower resolution) scan line. When the system, in this example, finishes the calculations in the third pass to produce the resulting row of pixels in the lower resolution image, the system proceeds to produce the next row in the lower resolution image by averaging the next 3 rows of pixels which are (because of overlapping) two lines down in the higher resolution image. That is, the next three rows of pixels selected will begin with the third scan line in the high resolution image, which will be a first pass (to produce the 2nd scan line of the lower resolution image) since it is calculating a new lower resolution scan line from a new group of three lines in the higher resolution image. The fourth scan line (of the hi-res image) consequently is the second pass (of the 2nd scan line of the lower resolution image) and the fifth scan line is the third pass (of the 2nd lowers scan line). It can be seen that this scheme causes the adjacent horizontal pixel areas which are averaged to overlap by one row. In addition, in the preferred embodiment, there is an overlap by one column for vertically adjacent pixel areas. FIG. 1 illustrates these overlaps. These overlaps are preferred, but not necessary, since they enhance the averaging process and improve the fidelity of the lower resolution image to the higher resolution image. Other schemes may be utilized in accordance with the present invention which permit greater overlap or no overlap.

In general, the amount of overlap by rows is determined by the expression "N−R" where N is the number of rows in a group of pixels being averaged from the high resolution image, and R is the ratio of the number of rows in the high resolution image to the number of rows in the low resolution image. Thus, in the case of a 1280×960 high resolution image which is converted, by 3×3 groups, to a 640×480 low resolution image, $N-R=3-960/480=1$. That is, the Overlap by rows is 1 in this case. Similarly, the amount of overlap by columns is "N−R" where N is the number of columns in the group of pixels being averaged from the high resolution ("hi-res") image and R is the ratio of the number of columns in the high resolution image t the number of columns in the lower resolution image. It can be seen that, given the same example, the overlap by columns is one (i.e., $N-R=3-1280/960=1$).

Figures 2A, 2B:
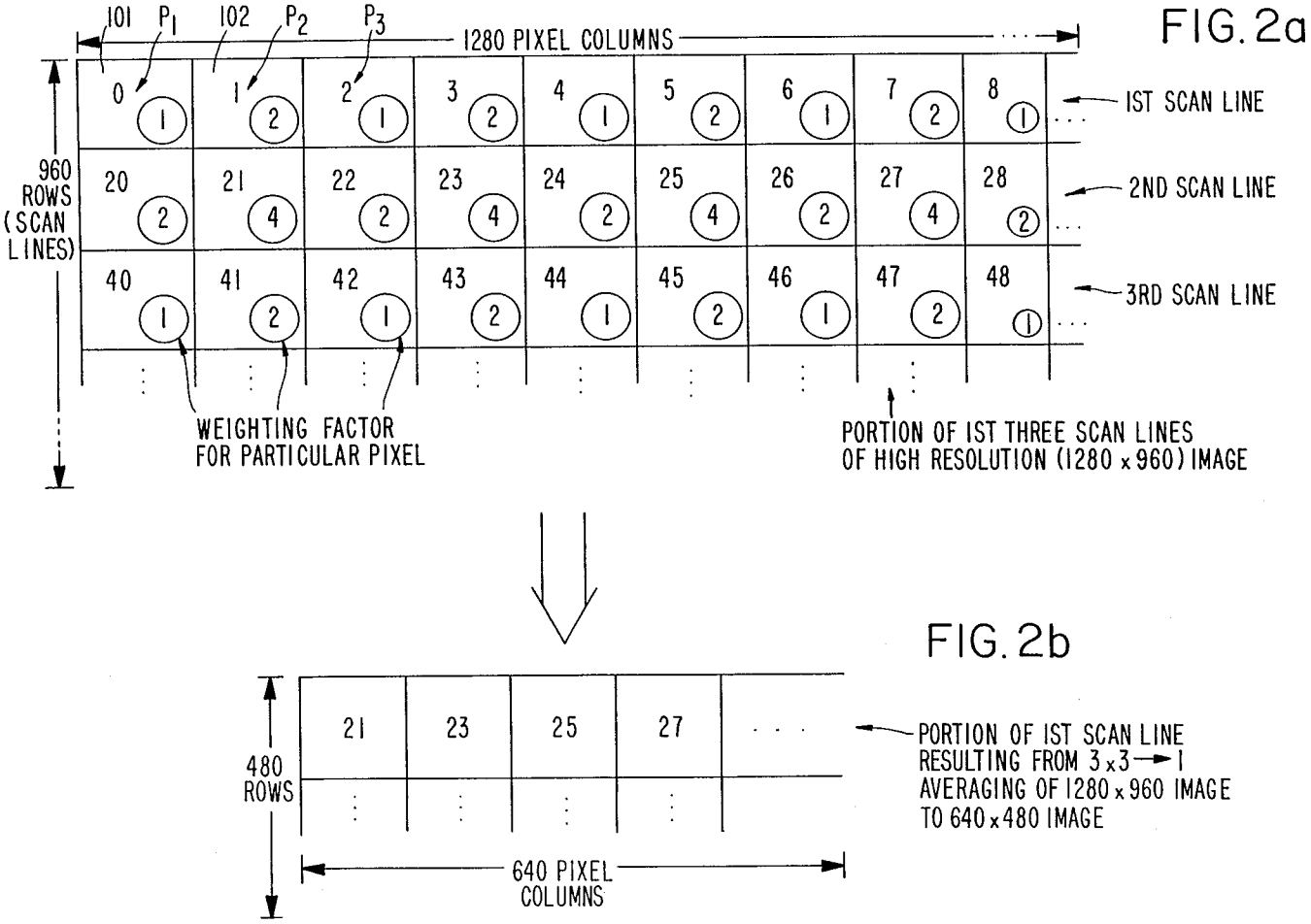
FIG. 2*a* shows a portion of the first three scan lines of a high resolution image and shows, in the circles within each quadrant, the weighting factor for a particular pixel in that quadrant.
FIG. 2*b* shows a portion of the first scan line in the low resolution image resulting from an averaging of the high resolution image shown in FIG. 2*a* to a lower resolution image shown in FIG. 2*b*.
Figure 3:
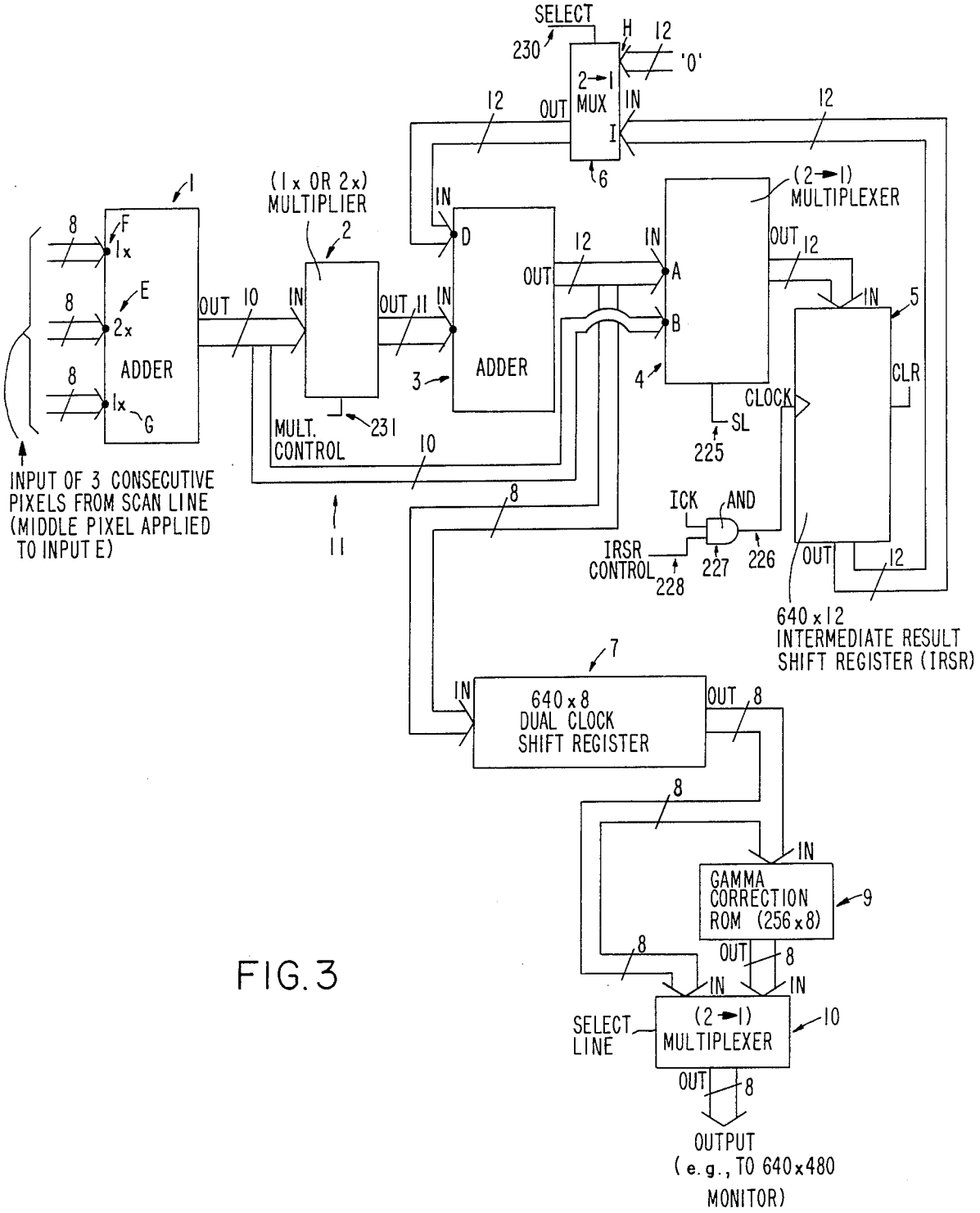
FIG. 3 shows the general architecture of a preferred embodiment of the invention for averaging a 3×3 group of pixels.

The conversion system of the present invention includes a pixel averaging means, such as that shown in FIG. 3, which shows an embodiment of a pixel averaging means for converting a 3×3 group of pixels into a single pixel. The pixel averaging means typically includes an input to receive pixel values from the high resolution image and various arithmetic and logic means for calculating a weighted average of the pixels in the area which is averaged. In the general case, the pixel averaging means converts an N×N group of pixel values from the high resolution image to a single pixel value in the lower resolution image. The N×N group of pixels includes N pixels in the first row and N pixels in every one of the N rows in the group of pixels. Such a N×N group has N2 pixels which are represented by N2 pixel values. The pixels may be weighted so that the lower resolution image more accurately reproduces the higher resolution image. For example, they may be weighted towards the center of the group such as the weighting scheme shown in FIG. 2*a*. The weights applied to a particular pixel are shown in a circle within the quadrant of that particular pixel. Thus, for example, the pixel 102 (P2) has a digital value 1 which is weighted by the weight 2 shown in FIG. 2*a* in the circle of the pixel 102. Immediately below pixel 102 is a pixel quadrant having a weight of 4 which will be multiplied by the pixel value 21 of that pixel. In the general case, each pixel value "$P_i$" has an associated weight $W_I$ and the pixel averaging means calculates the expression:

$$\frac{\sum_{i=1}^{i=N^2} W_i P_i}{\sum_{i=1}^{i=N^2} W_i}$$

FIG. 3 shows an embodiment of the 3×3 pixel averaging system of the present invention. The averaging calculation is done in 3 passes. The general components include an adder 1 which is coupled to a shifter 2 which effectively acts as a multiplier by a factor of 2 or a factor of 1 depending on the number of the pass in the calculation. The adder 3 is coupled to the shifter 2 by a bus carrying eleven signals and receives two inputs, one of which is from the shifter 2 and the other is the recirculated output from the intermediate result shift register 5. The output from the adder 3 is coupled to a 2 to 1 multiplexer 4. The output from the multiplexer 4 is coupled to the intermediate result shift register 5. The output from the intermediate result shift register 5 is recirculated back to the adder 3 through the multiplexer ("MUX") 6, which is normally set (by selecting the "I" input) to allow the output from the shift register 5 to be inputted to the adder 3 at input D of that adder. The multiplexer 6 is set to input zeros (a 12-bit zero signal shown as '0') to the adder 3 at input D during the first scan line, which occurs immediately after the beginning of a vertical scan. At all other times the multiplexer 6 is recirculating the output of the intermediate result shift register (IRSR) 5 back to the adder 3. Inputting zeros at input D during the first scan line may also be accomplished by clearing the IRSR 5 immediately before the first (top-most) scan line is processed (e.g. by asserting the signal CLR on the registers in the IRSR 5 during vertical retracing); this may be accomplished without any interruption by the MUX 6 (which may be removed) in the recirculated output from the IRSR 5. It will be appreciated that the large arrows and arrows with numbered slashes indicate buses and the slashes through the arrows indicate the number of digital signals carried on the bus.

A portion of the output from the adder 3 is coupled also to a dual clock shift register 7 which is described in more detail below. The output from the adder 3 is divided by 16 by taking the 8 most significant bits of the 12 bit line (appearing at the output from the adder 3) thereby producing the pixel averaging such as that shown in FIGS. 2*a* and 2*b*. The following description is specifically designed for the weighting factors shown in FIG. 2*a* wherein the weights for the first three pixels in the first pass are 1, 2, and 1 and the weights for the next three pixels below those prior pixels is 2, 4, 2, etc.

Figure 11:
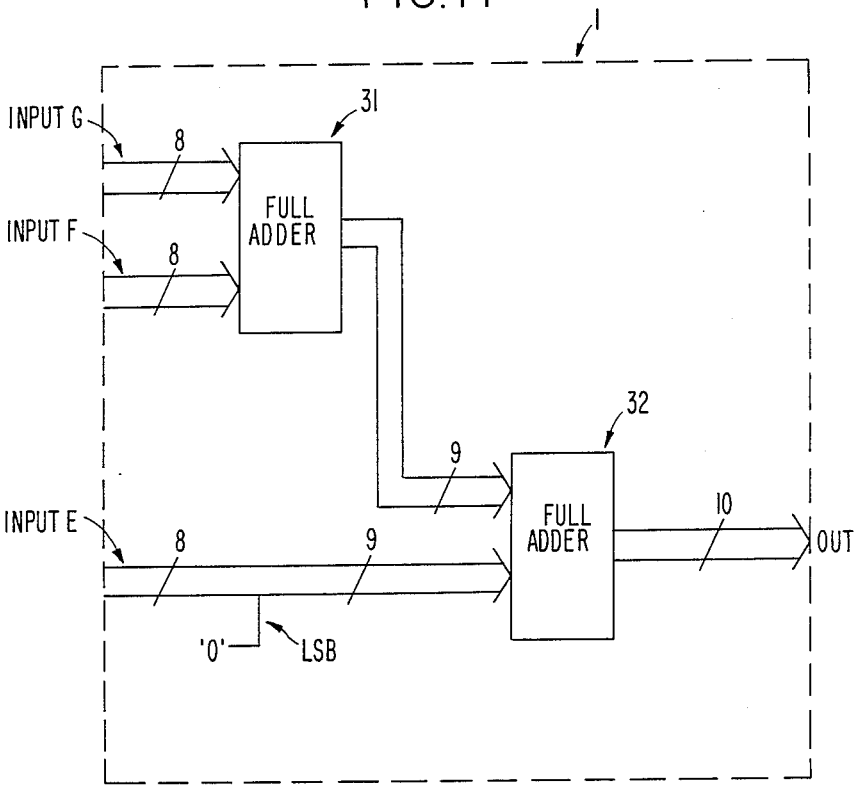
FIG. 11 shows embodiment of the Adder 1 of the system shown in FIG. 3.

The adder 1 is shown in greater detail in FIG. 11. The adder 1, as shown in FIG. 11, is implemented by two full adders 31 and 32; however, other ways which are well known in the art may be used to implement the adder 1. The full adder 31 has two 8-bit digital inputs G and F which are the "1×" inputs to the adder 1. The full adder 31 adds the digital values appearing at these inputs G and F and produces a 9-bit digital result which is outputted to the full adder 32, which has one of its two 9-bit inputs coupled to the output of the full adder 31. The other 9-bit digital input to the full adder 32 is a 9-bit digital signal derived from the input E (the input labelled "2×" of adder 1) by adding a "0" digital signal (as the least significant bit (LSB)) to the input E signal. It will be apparent that the addition of the "0" signal as the LSB of the input E signal effectively causes the signal at input E to be multiplied by a factor of 2. Thus, the full adder 32 adds the resulting summation from the full adder 31 to the product (2×input E) and produces the 10-bit output signal.

The operation of the pixel averaging system shown in FIG. 3 will now be described using the values shown in FIGS. 2*a* and 2*b* as an example. Each scan line is processed one at a time by summing, in the adder 1, groups of 3 consecutive pixels in the scan line. Thus, the first scan line is processed in the first pass, producing in the memory means (IRSR) 5, a row of 640 pixel values, each of which is the sum of 3 consecutive pixels from the first scan line. The memory means 5 is a shift register with 640 stages ("registers") each of which can hold digital values with up to 12 bits. The next scan line is inputted at the beginning of the second pass and groups of three consecutive pixels in the second scan line are added by the adder 1 and then multiplied by 2 by multiplier 2 and then added by the adder 3 to the prior first scan line's results which are stored in the intermediate result shift register 5. In the third pass, the third scan line is inputted, groups of 3 consecutive pixels from the third scan line are added by the adder 1, and each of these summations (of 3 consecutive pixels) is added to the results of the additions of the two preceding scan lines. These ultimate sums are divided by the sum of the weighting factors to produce the values of the pixels in the lower resolution image.

Thus, beginning with the first scan line as shown in FIG. 2*a*, values 0, 1, and 2 from that line are applied to the first stage adder 1. Since this is the first of three scan lines to be processed in the averaging procedure/calculation which produces the first scan line of the lower resolution image, this is the first pass. The value 1 from the first scan line will be applied at the 2× point (input E of adder 1) of the first stage adder 1 which will add the three values (0, 2×1, and 2), producing the result 4. That result is applied to the multiplier 2, also known as the shifter 2. This multiplier will be set at 1× for the first scan line (since this is the first pass) and is controlled by the multiplier control signal on line 231 which is generated by the finite state machine described below. Thus the result from that multiplier 2 will be the same as the input causing a 4 to appear at the input C of the adder 3; at the same time (during the first scan line), the multiplexer 6 will be selected to input zeros through the multiplexer 6 into the adder 3 at input D. The result of that addition (which is 4), will be carried to the input A of the multiplexer 4 which will, during a first pass, output that result 4 into the intermediate shift register 5. The next three values from the first line (which are 2, 3, and 4 because of the overlapping) are inputted into the adder 1, where the 3 is input at the 2× input. Again, in this particular embodiment there is an overlapping by 1 row and 1 column of adjacent 3×3 groups of pixels. The result of the additions by adder 1 is 12 (2+2×3+4) which result is output from the adder 1 and conveyed to the shifter 2 where the output is equal to the input (since the calculation is still on the first pass). The output 12 appears at the input C of the adder 3 and another zero from the "H" input of the MUX 6 appears at the input D of the adder 3. The result of the addition (0+12) in the adder 3 at this point produces the result 12 which is conveyed to the multiplexer 4 which again conveys the result into the shift register 5. At this point in the shift register 5, the values 12 and then the value 4 appear in the left-most (going left to right) registers with all the remaining registers having a zero (i.e. "12, 4, 0, 0 . . . , 0").

The rest of the first scan line is processed in a similar manner with the first scan line of 1,280 pixels being reduced to 640 pixel values which are stored in the shift register 5. It may be necessary, when converting from one image to a lower resolution image, to "input" extra pixels at the end of a row of high resolution ("hi-res") pixels or to "input" extra hi-res rows of pixels at the end (usually at the very bottom of the image/screen) of a vertical scan. For example, when averaging from a 1280×960 image to a 640×480 image by 3×3 groups, with an overlap between adjacent groups of one row and one column as shown in FIG. 1, it will be necessary to "input" an extra pixel for each scan line at either the end or the beginning of the line to assure that the last group of consecutive pixels from the hi-res image is complete. In this example, it will also be necessary to input an extra row of pixels so that the average can be computed for the last scan line of the 640×480 low resolution ("lo-res") image. This usually arises because of the overlapping between adjacent groups (e.g. 3×3) of pixels from the hi-res image. FIG. 1 illustrates this problem when the hi-res image is, for example, 7 column×6 lines. It can be seen that the averaging of that 7×6 image by 3×3 groups (with a vertical and horizontal overlap as shown in FIG. 1) will fit precisely across for each row of the hi-res image but the sixth scan line of the hi-res image remains unused unless a seventh scan line is "inputted" (allowing the 5th, 6th and imaginary 7th lines to be averaged to form the third scan line of the lo-res image). In the case of averaging from a 1280×960 image to a 640×480 image as noted above, the 640th group of consecutive pixels from a hi-res row will be only 2 pixels rather than the normal 3. Hence, an extra pixel would normally be "inputted" at the end of the row to make the 640th group complete with 3 consecutive pixels.

The general case is given by the expression (N−W) modulo S=0, which will determine what N should be and must be evaluated for both rows and columns. In the case of whether extra pixels should be added to a row, N is the number of pixels in the hi-res row, W is the number (e.g. 3) of pixels in a row of the group of pixels (e.g. 3×3 group) and S is horizontal "step" which is taken to move from one group of pixels to the next group horizontally (e.g. S=2 as shown in FIG. 1). In the case of whether extra rows of pixels should be added to form the last (bottom) scan line of the low resolution image, N is the number of rows in the hi-res image, W is the number (e.g. 3) of pixels in a column of the group of pixels (e.g. a 3×3 group) and S is the vertical "step" which is taken to move from one group of pixels to the next group vertically (e.g. S=2 as shown in FIG. 1). As is well known, the expression (N−W) modulo S=0 requires one to empirically determine N to get the remainder of the division to be zero, as is well known in the art.

In the case of the 1280×960 to 640×480 conversion shown in FIGS. 2*a* and 2*b*, 1281×961 hi-res pixels must be inputted. Since only a single extra pixel is required for each row in a preferred embodiment described herein, the extra pixel is given the value zero so that the system actually receives 1280 hi-res pixels for each scan line. Similarly, the last row of hi-res pixels (the 961st row) is all zeros and thus the system actually receives 960 hi-res scan lines. An alternative to inputting zeros for the extra pixel or rows of pixels would be to repeat the last actual pixel (in the case of the extra pixel for each row) or to repeat the last actual row of pixels.

It is appreciated that the first three pixels will be added and stored at the right-most register (closest to the output) of the shift register 5 at the end of the processing of the first scan line (first pass). At the beginning of the second pass the result from the addition of the first three consecutive pixels of the first scan line will be applied to the input D of the adder 3 (through the MUX 6). This will serve to cause the summation of the first three pixels of the first scan line and the first three pixels of the second scan line. Thus, the first three pixels of the second scan line (those pixels having the values 20, 21 and 22 as shown in FIG. 2*a*) are applied to the adder 1, where the pixel having a value of 21 will be multiplied by 2 and then added to the pixel values 20 and 22. The output of the adder 1, which will be 84, will be applied to the shifter 2 which will multiply the input by 2 (by performing a shift to the left (LSB on right) of the value which is input to the shifter 2). This will produce the value 168 which is applied to the input C of the adder 3. At the same time, the input D to the adder 3 will receive the output of the shift register 5 which, at that point will be the summation of the first 3 pixel values of the first scan line (that value being 4); the adder 3 adds those two numbers (168+4) producing the result 172 which is outputted and applied to the input A of the multiplexer 4 which causes that value, 172, to be applied again to the intermediate shift register 5 which has shifted one place to the right allowing the new value to be stored and the old values to move to the right one location.

The processing of the second scan line continues in a similar manner producing at the end of the second scan line, 640 summations, each summation being of 6 pixels, which are stored in the shift register 5. That is, the right-most register (closest to the output) of the shift register 5 will have a value of 172 resulting from the weighted addition of the first three pixels of the first scan line and the first three pixels of the second scan line. Similarly, the next register to the left of that register will contain a value 196 which corresponds to the weighted sum of the values of the 3rd, 4th, and 5th pixels of the first scan line and of the 3rd, 4th, and 5th pixels of the second scan line.

It will be understood in this example that as the third scan line is inputted into the first stage adder 1, and the results derived from that adder 1, those results must be stored for the averaging of the pixels in the 3rd, 4th, and 5th scan lines of the high resolution screen, which scan lines constitute the next series of lines which will be averaged below the first three scan lines. That is, the 3rd, 4th and 5th scan lines of the high resolution image will be averaged to produce the 2nd scan line of the low resolution image, and thus the third pass of the prior calcuation is also the first pass of the next calculation. Thus, the result of the adder 1 upon the third line must be saved before the additions to the summations to the two preceding lines. This is accomplished by the 10-bit/signal bus 11 coupled from the output of the adder 1 to the input B of the multiplexer 4; this bus feeds the result of the adder 1 upon the third line into the shift register 5.

The operation of the system shown in FIG. 3 will now be described with respect to the processing of the third scan line (third pass). At the beginning of the inputting of the third scan line, the shift register 5 is completely full with the 640 summations of the first two scan lines, each of those summations including six pixels. Those summations will be output from the shift register 5 through the MUX 6 to the adder 3 at input D. Thus, the right-most register, having a value 172, will produce the value 172 at the input D of the adder 3 when the summation of the first three pixels from the third scan line appears at input C of the adder 3. The shifter 2 does not shift the third line additions thus, the input C of adder 3 from the first three pixels of the third scan line (FIG. 2*a*) will be 164 ($40+2\times41+42$). The adder 3 adds 164, and 172, producing a result 336, which is divided by 16 yielding 21, which is then applied to the input of dual clock shift register 7 as the first value which will be outputted to the lower resolution display apparatus, such as a computer monitor. The division by 16 is accomplished by taking the 8 most significant bits (MSB) of the 12-bit output of the adder 3; it will be apparent to those in the art that this results in dividing the output of the adder 3 by the value 16. At the same time, the bus 11 will carry the result (164) of the addition of the first three pixels of the third scan line to the multiplexer 4 at input B, which multiplexer 4 selects (under control of a signal on line 225 during the third pass) the input B for inputting to the intermediate shift register 5. Thus, the value 164 will appear in the left-most register (closest to the input of the shift register 5) as it is outputted by multiplexer 4. The multiplexer 4 selects input A (of multiplexer 4) for outputting from that multiplexer during the first and second pass; during the third pass, input B is selected for outputting. Thus, the values of the summations of the three consecutive pixel groupings of the third scan line will be stored in the intermediate result shift register 5. The system continues circulating through the third line such that the summations of three consecutive pixels from the third scan line will appear in the shift register 5, completely filling that shift register at the end of the processing of that line and the output of the $3\times3$ averaging for the first 3 scan lines will appear in the dual clock shift register 7 (described below).

It can be seen that during the processing of the third pass 640 summations from the third scan line (each of those summations being formed from the addition of three consecutive pixel values from the 3rd scan line) will be stored in the intermediate result shift register 5. At the same time the summations of groups of three consecutive pixels from the third line will be added to the respective summations from the first two scan lines stored in the shift register 5. At the end of the processing of the third pass, the dual clock shift register 7 will contain one complete scan line for the lower resolution image. At the same time the intermediate result shift register 5 will be prepared to average the next three lines since it contains the 640 summations of three consecutive pixels which will be the first pass for the next three scan lines (to form the 2nd lo-res scan line) which, in this description, will be the third, fourth and fifth scan lines. The processing will then continue by inputting the fourth scan line (which is the 2nd pass with respect to the processing of the second scan line of the lo-res image) to the pixel averaging means shown in FIG. 3. Thus, values from the fourth scan line will be entered, in three consecutive pixel groupings, to the adder 1. Again, the middle pixel in each of the three consecutive groupings of pixels will be applied to the input E where the value is multiplied by 2 before addition to the other two inputs. The output of the adder 1 proceeds to the multiplier 2 which, in the case of the fourth scan line, will multiply each summation by 2 since the fourth scan line is, in the context of processing the 3rd, 4th and 5th scan lines, the second pass. The processing continues as described above resulting in the storage of the second complete scan line of the lo-res image in the dual clock shift register 7 which is output to the lower resolution display apparatus such as a computer monitor. It can be seen that the bus 11 serves to convey the 640 summations from adder 1 to the intermediate result shift register 5 so that the third pass values are stored for use as the first pass for processing the next 3 scan lines down the hi-res screen.

The output from the dual clock shift register may be provided "uncorrected" to a lower resolution display apparatus or alternatively, the output from the dual clock shift register may be run through a gamma correction ROM which is utilizied, as is well known in the art, to correct for non linearities in the display mechanism and receptors in the eye. Thus, the multiplexer 10 may select between two inputs, one of which provides the uncorrected averaged scan line, or may select the corrected average values produced by the gamma correction ROM 9 as is well known in the art. It will be appreciated that if no color computer displays will be used, the gamma correction ROM 9 and multiplexer 10 are unnecessary and the output of the pixel averaging system may be taken from the output of the dual clock shift register 7. It is understood that the digital output from the multiplexer 10 will be converted to an analog signal which a computer monitor can accept, through Digital-to-Analog Circuitry (DAC), as is well known in the art.

The dual clock shift register 7 is used because of the different clock rates at the output and the input to the shift register 7. These different clock rates arise because of different pixel scan rates on the different screens (e.g. a high resolution scan line requires a faster pixel scan rate than a lower resolution scan line in order to scan both lines across a screen in substantially the same time). In particular, in one embodiment of the invention the input to the dual clock shift register 7 is about twice as fast as the output from that shift register. A typical shift register includes only a single clock, and therefore a special aspect of this invention involves this dual clock shift register 7 which appears at the output section of the pixel averaging means shown in FIG. 3. Of course, it will be appreciated that a normal shift register may function in place of the shift register 7 when the input and output rates to the shift register 7 are the same and therefore a single clock is all that is required. Other memory devices may be used in place of the dual clock shift register; for example, RAM (random access memory) or a FIFO (first-in-first-out) may be used, but these alternative memory devices require more chip space than the dual clock shift register and typically could not operate as fast.

In the particular embodiment of the invention shown in FIG. 3, the input clock has a frequency of about 50 megahertz (MHz) and the output clock frequency rate is approximately 25 MHz. In this particular implementation, inputted data will not overtake outputted data (and thereby be lost); of course, if these frequencies are modified, care must be taken not to have the inputted data be lost as it is clocked out of the registers. That is, since the input is faster than the output, one must take care to prevent the inputted data from being lost. Normally, the input clock rate must be less than twice the output clock rate.

Figure 8:
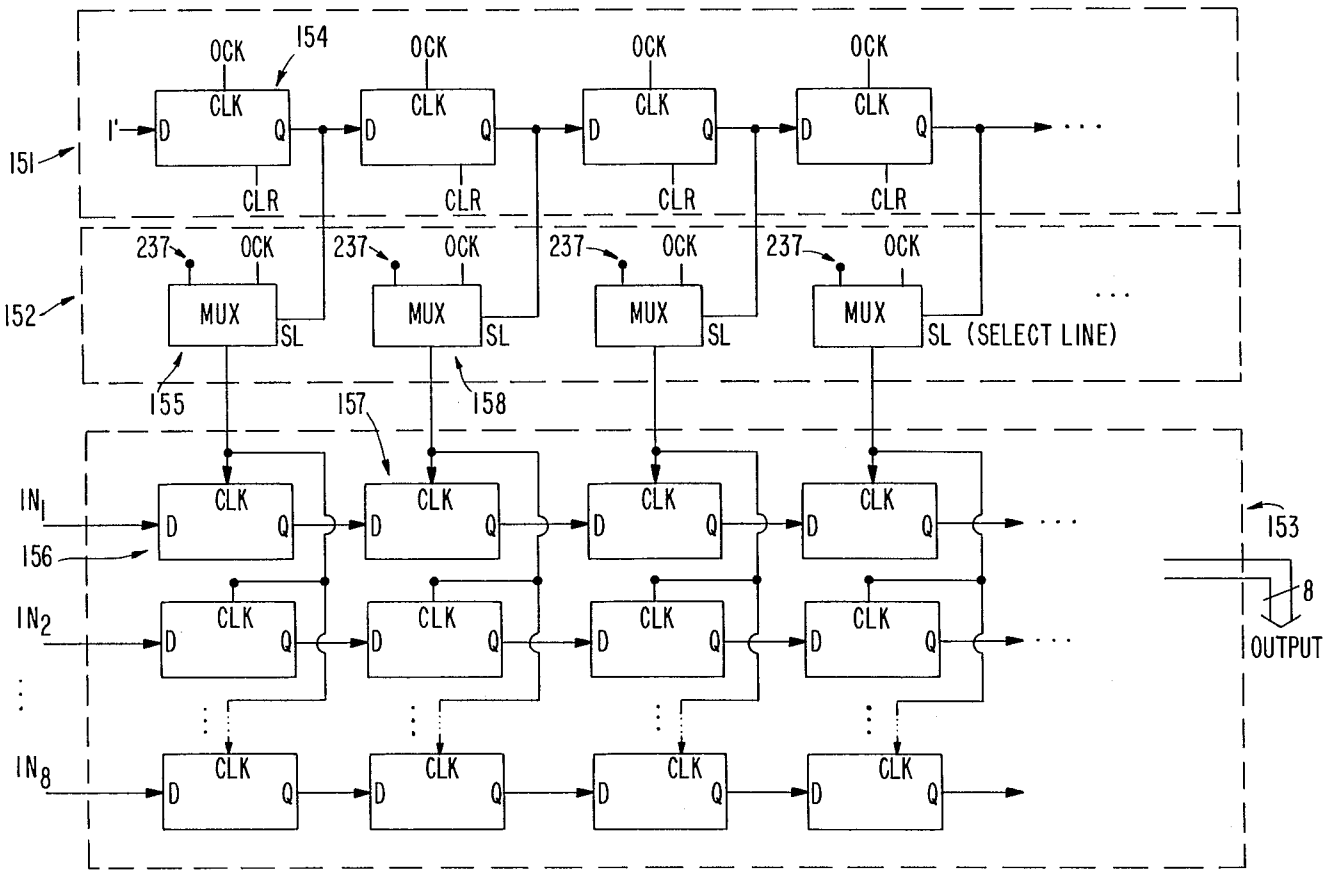
FIG. 8 is a schematic drawing showing the dual clock shift register according to the present invention.
Figure 7:
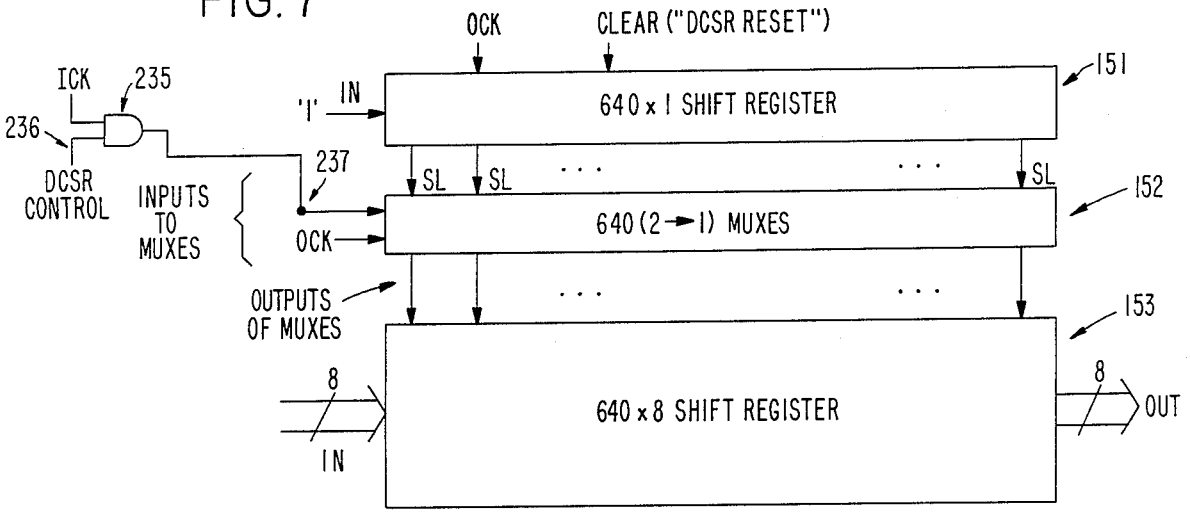
FIG. 7 shows the general construction of a dual clock shift register according to the present invention.

FIG. 7 shows the general structure of the dual clock shift register (DCSR) 7. There are three main components of that shift register 7, which are the shift register 151, the muxes 152 and the 640×8 shift register 153. The shift register 151 includes 640 registers (stages) for storing one of two logical states and hence it is a 640×1 shift register (SR). The clock for each of those registers is the output clock (OCK) which is coupled to the clock input of each register 154 as shown in FIG. 8. Each register 154 in the shift register 151 also includes a clear input which is coupled to receive a clear signal immediately after the end of a third pass. Thus, at the very end of a third pass, all of the registers 154 in the shift register 151 will have been cleared to 0 such that the Q outputs of each of the registers 154 has the value 0 which is a logical state. Each of the registers 154 is a D-type flip-flop which are coupled in series to form the shift register 151. It will be apparent to those in the art that the other circuits may be utilized to implement each of the registers 154. Thus, the output of the first register 154 (on the far left) is coupled to the input of the second register in the shift register 151. The input of the first register 154 in the shift register 151 is coupled to a signal which is fixed at a first logical state, such as a logical 1. Of course, that could also be set at logical 0 if an inverter is coupled in series to the select line input of the muxes in the muxes 152 and the shift register 151 is set to all 1's instead of cleared to all 0's at the very end of a third pass.

It can be seen that as the output clock is asserted, the zeros stored in the registers in the shift register 151 are shifted to the right and 1's are shifted into the shift register 151. The output of each of the registers in the shift register 151 is coupled to an associated multiplexer (MUX) in the 640 (2 to 1) muxes 152. Thus, the first multiplexer 155 is associated with the first register 154; the second register immediately to the right of the first register 154 in the shift register 151 is associated with the second MUX 158 immediately to the right of the first MUX 155. Each MUX in the muxes 152 has two multiplexer inputs. The first multiplexer input 237 of each of the multiplexers in the muxes 152 is coupled, through the AND gate 235, to receive a signal corresponding to the input clock rate (ICK) when the DCSR enable signal is asserted on line 236 (the DCSR Control), and the second multiplexer input is coupled to the output clock (OCK). Each MUX in the group of muxes 152 has an output which may carry either the ICK or OCK signal depending on the logical state of the select line (SL) on the MUX. When the DCSR enable signal is asserted on line 236 (an input to the AND gate 235) the ICK signal will appear at node 237 which is coupled to the first multiplexer input of each mux in the muxes 152, as shown in FIGS. 7 and 8. Of course, when the DCSR enable signal (on line 236) is NOT asserted, then node 237 will be inactive and no input clock signal will be available to the muxes 152, although the output clock signal will still be available. Thus, it is possible to disable the input side only of the DCSR. If an application of the DCSR does not require the capability to disable one of the clock signals, then the clock signals may be applied directly to the multiplexers inputs.

The select line of the first MUX 155 is coupled to the output of the first register (left-most) in the shift register 151. Similarly, the select line of the second MUX 158 (immediately to the right of the first MUX 151) is coupled to the output of the second register in the shift register 151, which thereby associates the second register with the second MUX 158. Thus, it can be seen that the Q output of the first register 154 will control the MUX 155 which can output one of the two clock rates which is inputted to that MUX. In a particular implementation of the invention, a 1 appearing at the output of the first register 154 will cause the input clock signal to be outputted from the MUX 155 as long as the DCSR enable signal is asserted on line 236. At the same time, the second register in the shift register 151 could have a 0 at its output and therefore select the output clock rate for outputting from the second MUX from the group of muxes 152.

FIG. 8 shows a portion of the shift register 153 which contains 8 "rows" of 640 one bit registers coupled in cascaded series. Thus, the first row of registers shown in the shift register 153 of FIG. 8 includes 640 one bit registers cascaded in series; similarly, the second row, which is coupled to receive the input "IN2", has 640 one bit registers coupled in series. There are eight such rows of registers making the 640×8 shift register 153. The first column of registers (the left-most colum in shift register 153) is coupled to the same clock signal which appears at the output of the first MUX 155. It will be understood that the first column forms a 1×8 reigster. Similarly, each register in the second column of registers is coupled to the same output of the second MUX 158 in the group of muxes 152 thereby receiving the same clock signal.

At the beginning of each row of 640 registers in the shift register 153 is a first register the input of which is coupled to one of the bit lines which is an input to the dual clock shift register 7 as shown in FIGS. 7 and 8. The output of that first register 156 is coupled to the input of the second register 157 in the same row. Unlike a typical shift register, however, the clock input for the first register 156 in the first row is different from the clock input for the second register 157 of the first row. That is, the clock input for the first register 156 is coupled to the output of the first multiplexer 155 while the clock input of the second register 157 is coupled to the output of the second MUX 158.

The operation of the dual clock shift register 7 will now be described with reference to FIGS. 7, 8 and 9 and the above-described described example of averaging by 3×3 groups. It will be appreciated that at the end of a third pass the shift register 7 is completely full of the average pixel values for a particular scan line of the lower resolution image. At the same time, the shift register 151 will be completely full of 1's which causes the entire shift register 153 to be controlled by the input clock. A the very beginning of the next pass, which is actually a second pass (since the preceding third pass is the first pass for the next three scan lines which are averaged) the clear signal is asserted for all of the registers in the shift register 151 causing the outputs of each of those registers to be 0 thereby selecting the output clock signal as being the output from each of the muxes in the set of muxes 152. Thus, the dual clock shift register 7 is completely under the control of the output clock (OCK). Since the shift register 151 is controlled by the output clock it will prevent the incoming signals to the shift register 153 from "overriding" the outgoing signals which leave at one half the rate at which the incoming signals enter the shift register 153. (It should be noted that the input signals will not actually override the output signals as long as the registers containing the output signals are controlled by the output clock; what happens when the input signals overtake the output is that the input signals are clocked into "oblivion" —i.e. lost.) As the averaged values leave the dual clock shift register 7 under the control of the output clock, the pixel averaging means is receiving the second of three scan lines which will be averaged. As described previously, 640 summations of three consecutive pixels each is performed on that second line and those values are summed with the 640 summations from the first line of those three lines. At the same time the registers 154 are shifting 1's into the shift register 151 to fill that shift register with 1's as it shifts the 0's out. The movement of the row of 1's through the shift register 151 changes the control of the shift register 153 since the outputs of the registers in the shift register 151 control the select lines of the muxes in the 640 muxes 152.

Figure 9:
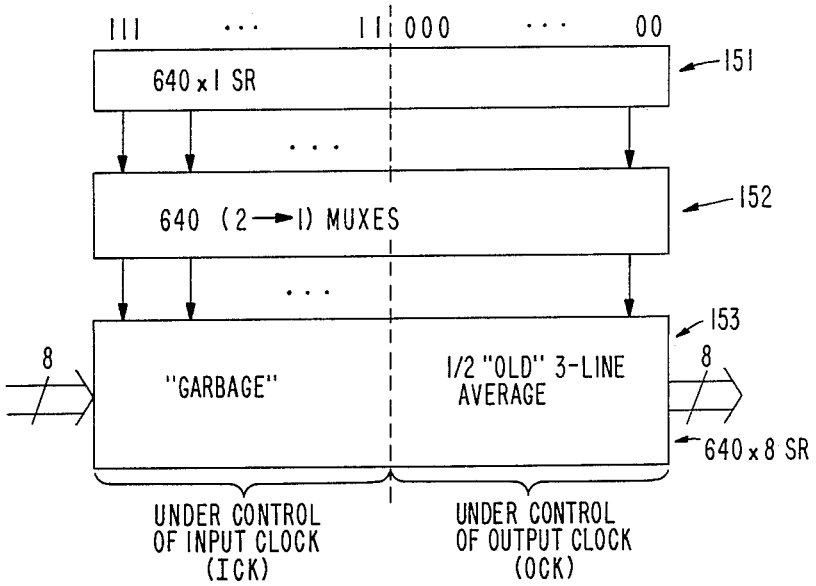
FIG. 9 shows the operation of the dual clock shift register at a particular stage of processing.

FIG. 9 shows the status of the dual clock shift register at the end of the second pass. In particular, FIG. 9 shows that the shift register 153 is split in half such that the first half (input side) of that shift register is under the control of the input clock and the second half is under the control of the output clock. The second half contains one half (320 averaged pixel values) of the "old" 3-line average. The first half of the shift register 153 will contain "garbage" which will be written over during the third pass when 640 averaged pixel values will be inputted to the dual clock shift register 7. It can be seen that because the input clock rate is no more than twice the frequency of the output clock rate (and preferrably just slightly less than twice the frequency) that the new averaged values are not lost (by running into the boundary between old and new) as those new values enter the dual clock shift register 7.

Figure 10:
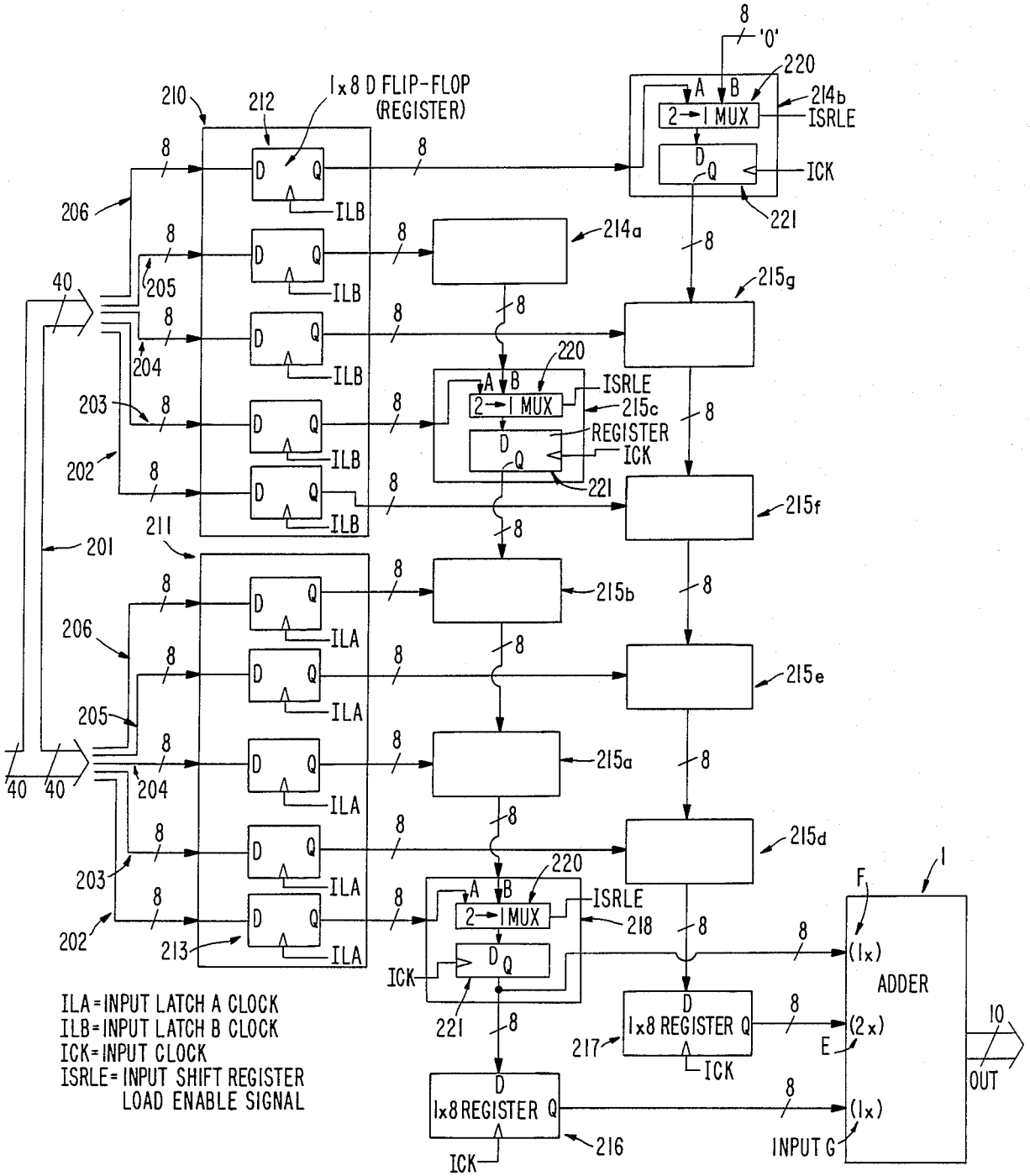
FIG. 10 shows an embodiment of the input section of the system shown in FIG. 3.

One way of implementing an input section for the pixel averaging means shown in FIG. 3 is shown in FIG. 10. The input section includes two input latches 210 and 211 and two input shift registers which are arranged in columns as shown in FIG. 10. The first input shift register includes registers 214*a*, 215*c*, 215*b*, 215*a*, 218 and 216. The second input shift register includes registers 214*b*, 215*g*, 215*f*, 215*e*, 215*d* and 217. In addition to a normal 8-bit register 221 (which may be implemented by D flip-flops), certain of the registers also include a 2 to 1 MUX 220. There are five 1×8 registers in each of the latches 210 and 211. Thus, the input latch A which is input latch 211 contains five 1×8 registers 213; similarly, the input latch B (input latch 210) includes five 1×8 registers 212. The latches collect an even number of pixels and cause the pixels to be loaded in a parallel fashion into the two shift registers which are clocked to cause the data to be inputted into the adder 1.

The bus 201, which is a 40 signal bus provides five pixels simultaneously over the five 8 signal buses 202, 203, 204, 205 and 206. It can be seen that when the input latch A clock ("ILA") is asserted the input latch A will accept five pixels and hold those values until the next input latch A clock. Similarly, when the input latch B clock ("ILB") is asserted the input latch B will collect five pixels from the bus 201. The pixels signals' must be applied to the bus 201 such that the first (left-most) pixel in a line appears on bus 202 and the next pixel (the second pixel) appears on bus 203, and the next pixel (the third pixel) appears on bus 204, and so on.

Figure 13:
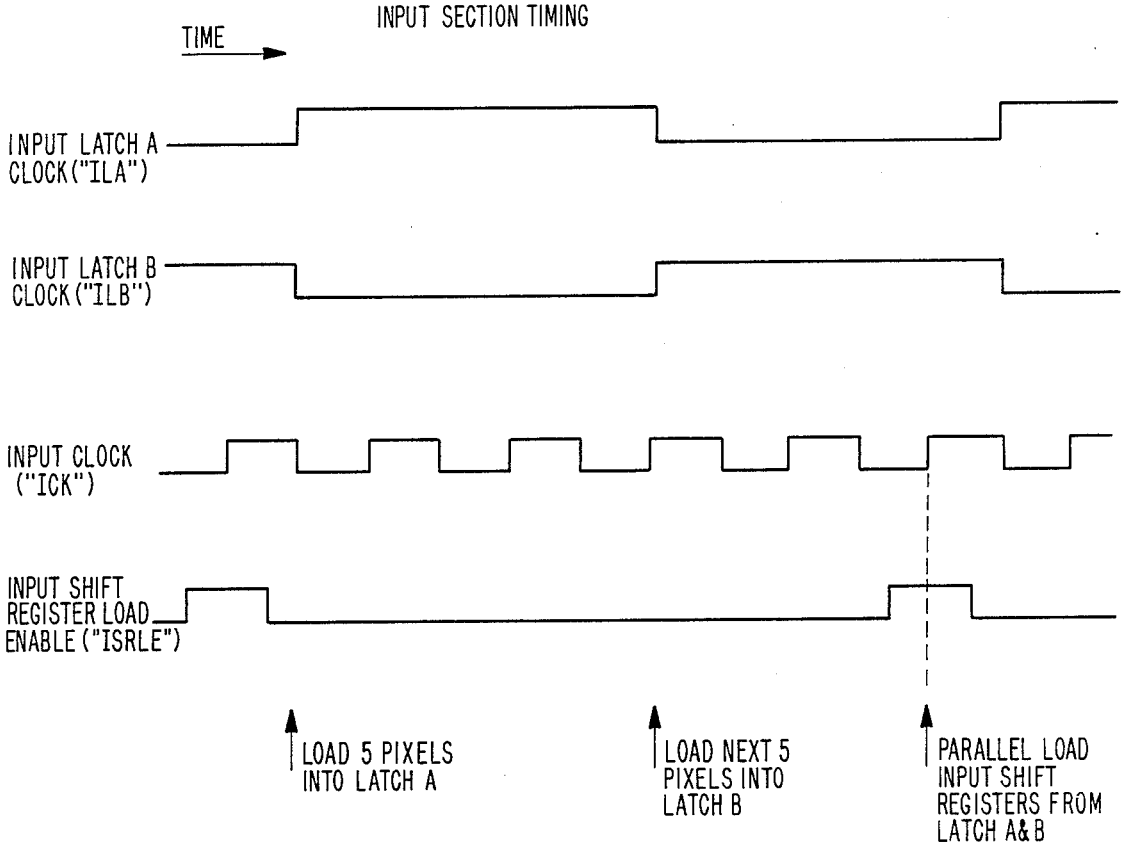
FIG. 13 shows the timing patterns of various signals for controlling the input section of the system shown in FIG. 3.

Timing for the input section as shown in FIG. 10 is shown in FIG. 13. The signals ILA and ILB are active high. The registers and latches are clocked on the rising edge of the particular signal. In the typical implementation of the invention described above wherein a 1280×960 high resolution image is converted, by 3×3 averaging with overlapping as shown in FIG. 1, the input latch clock A will be approximately 10 megahertz and the input clock (ICK) will be approximately 50 megahertz. The input shift registers will be parallel loaded (except for the last stage/register of each shift register—i.e. registers 216 and 217) on the rising edge of the input clock when the input shift register load enable signal is asserted. Registers 216 and 217 always shift from the previous stage as shown in FIG. 10. No multiplexers are included as part of the registers 216 and 217. All stages in each of these input shift registers shift from the previous stage on the rising edge of the input clock when the input shift register load enable signal is not asserted.

The internal details of the various registers which comprise the input shift registers are shown in FIG. 10. Specifically, register 215*c* shows the internal structure of that register and registers 215*a*, 215*b*, 215*d*, 215*e*, 215*f* and 215*g*. As shown in the register 215*c*, the output from the previous stage is coupled to the B input of the 2 to 1 MUX 220. The parallel load from the input latch B is coupled to the input A of the 2 to 1 MUX 220, which MUX selects, according to the input shift register load enable signal, whether input A or input B is outputted to the register 221 which is a 1×8 register which has a D input and a Q output and a clock input signal which is coupled to the input clock. The register 214*b* shows the details of that register and the register 214*a*. It can be seen that, since there is no prior stage/register with respect to these two registers, that the B input to the multiplexer 220 is set at a fixed logical state. In all other respects, the register 214*b* and the register 214*a* are the same as the registers shown as 215*c*. The register 218 is another variation on the theme and is identical to the register shown as 215*c* except that the Q output of the register 221 is coupled to the next register and to the input F of the adder 1. When the input shift register load enable (ISRLE) is asserted, the A input to each of the multiplexers 220 will be selected for outputting through the multiplexer to the D input of the various registers in the input shift registers. When the input shift register load enable signal is not asserted, the B input to the multiplexers 220 is selected, thus causing the normal shifting from previous stage to next stage. Thus, the ISRLE signal, when asserted, allows ten new pixel values to be loaded into the ten registers (registers 218, 214*a*, 214*b* and 215*a–215g*) as shown in FIG. 10.

The operation of the input section of the pixel averaging system shown in FIG. 10 will now be described with reference to FIGS. 10 and 13. The input section is controlled by the four timing signals shown in FIG. 13, which are permitted to run continuously. Those signals should be synchronized as shown in FIG. 13 to the input clock (ICK) signal. The operation begins with the loading of five pixels in the latch A (input latch 211) when the input latch A clock (ILA) is asserted. Next, the five next pixels are loaded into input latch B (input latch 210) when the ILB signal is asserted. While the 10 pixels have been loading into latches A and B, the input shift registers have been shifting the previous 10 pixel values down the input shift register such that those prior ten pixel values will not be overwritten when the parallel load occurs from the input latches A and B. Near the end of the assertion of the ILB signal, the input shift register load enable signals is asserted causing the new pixel values to appear at the D input of the various registers in the input shift registers shown in FIG. 10. At the next input clock, these ten new pixel values are clocked to the Q outputs of the registers. Subsequent input clocks will cause the shifting of the ten new pixel values into the adder 1 for further processing by the system shown in FIG. 3. It can be seen from FIG. 13 that there are five input clocks (ICK) following the parallel loading into the input shift registers; hence, when the next ten pixels are loaded into the input shift registers the prior pixels will have exited the input section except for pixel values stored in registers 216 and 217 which will exit at the next input clock. The input clock (ICK) signal is half the frequency of the pixel clock which is the clock rate at which the high resolution pixels are propagated to and displayed on the high resolution image display apparatus.

It will be apparent to one with ordinary skill in the art that other ways may be utilized to introduce the input stream of pixel values in the high resolution image to the adder 1 of FIG. 3.

Figure 12:
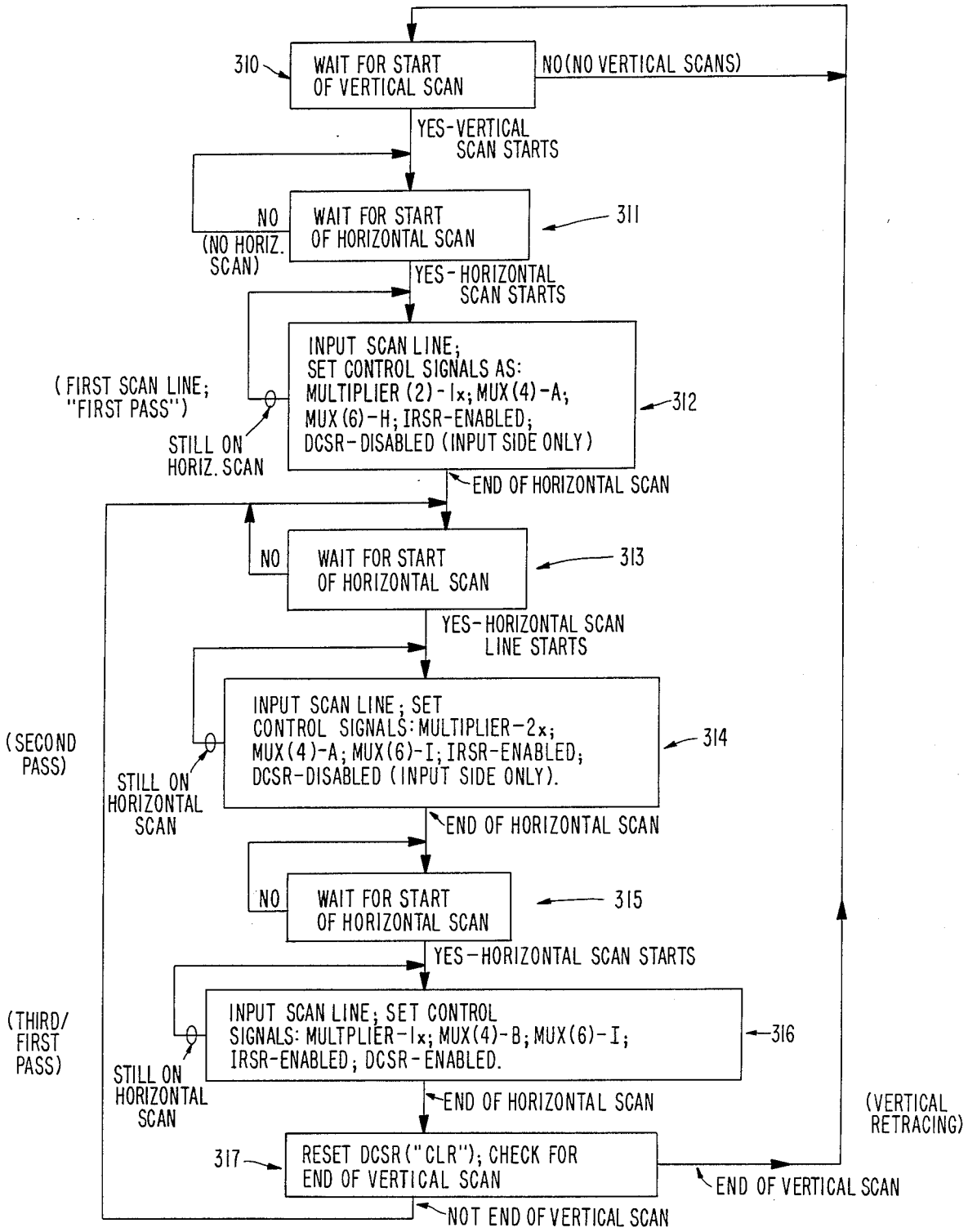
FIG. 12 shows a flow chart for a finite state machine for controlling the operation of the system shown in FIG. 3.
Figure 15:
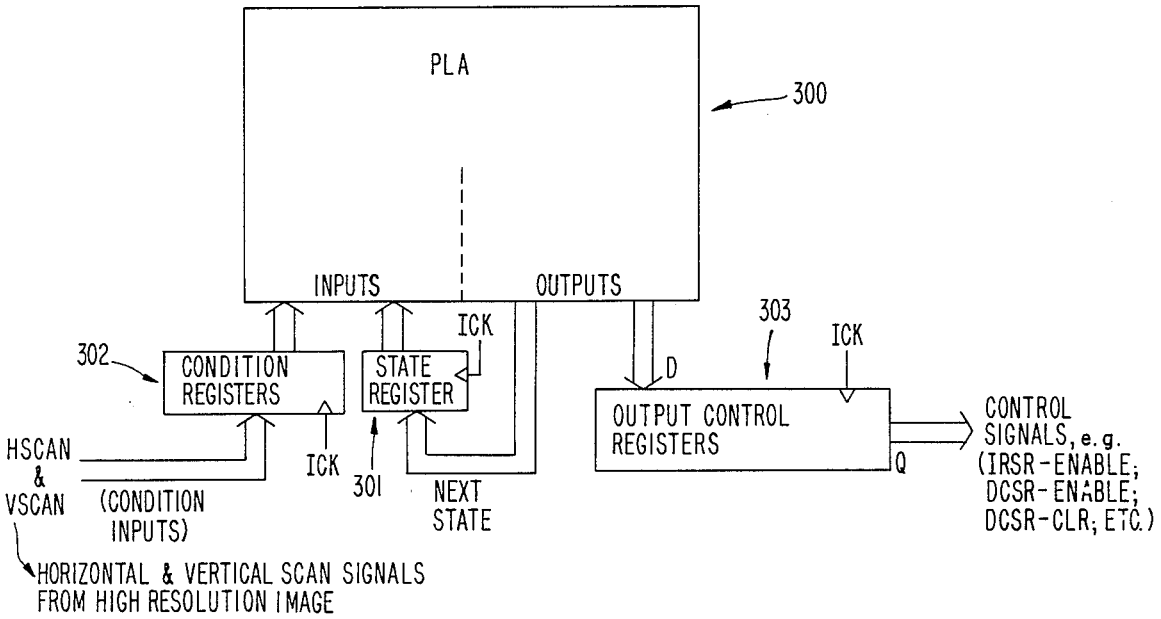
FIG. 15 shows an example of a finite state machine for controlling the operation of the system shown in FIG. 3.

The operation of the pixel averaging means shown in FIG. 3 may be controlled by a finite state machine which is implemented in a fashion which is well known by those skilled in the art. FIG. 15 shows an example of a finite state machine for controlling the pixel averaging means of the invention, such as that shown in FIG. 3. The finite state machine uses a programmable logic array to implement a video processing sequence shown in FIG. 12. FIG. 12, in flow chart form illustrates the various commands and control signals, in their appropriate order. In particular, certain control signals associated with the pixel averaging means shown in FIG. 3 are asserted or not asserted depending on the state (shown in the state register 301) at a particular time of the finite state machine. Each of the boxes in FIG. 12 represents a state during the video process sequence. Thus, state 310 is a wait state during which, at each clock input, the programmable logic array checks to see whether the state is still state 310 and checks the status of the vertical scan (VSCAN) signal.

During each state, the programmable logic array (PLA) at each input clock checks the status of the state register 301 (where the state datum is stored) and checks certain input conditions (HSCAN—horizontal scan; VSCAN—vertical scan) which are registered into the PLA 300 at the rising edge of the input clock by the condition registers 302. These condition registers 302, which may again be D flip-flops, receive as inputs the horizontal and vertical scan signals from the high resolution video circuitry. The registers 302 at each input clock provide the status of the VSCAN and HSCAN signals to the PLA 300. The state register 301 at each input clock provides the current state in the processing sequence to the PLA 300.

Figure 14:
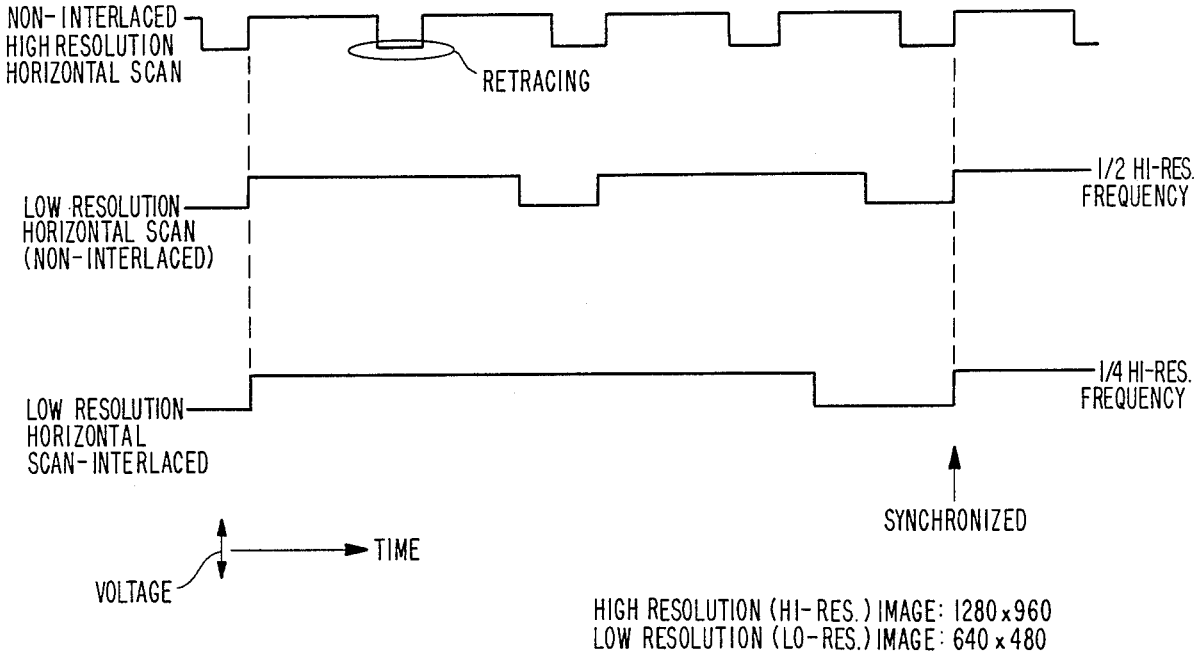
FIG. 14 shows the relative timing of the horizontal scan signals for different screens.

FIG. 14 shows HSCAN signals for the low and high resolutions without interlacing (non-interlaced). FIG. 14 also shows a lo-res HSCAN interlaced signal, which resembles the horizontal scan in consumer televisions (e.g. NTSC video standards). The HSCAN signals are usually high when asserted; thus, vertical retracing occurs when the HSCAN signals are low (e.g. about 0 volts). The high resolution VSCAN and HSCAN signals are usually supplied by the computer's video processing circuitry; sometimes, however, a particular computer, to which one seeks to add an apparatus of the invention, may generate the inverse of these signals. The inverse signals are HBLANK and VBLANK, which may be converted to the HSCAN and VSCAN signals by inverters, as is well known in the art. The low resolution HSCAN signal may be generated by well known circuitry which receives the high resolution HSCAN signal and converts it to the synchronized low resolution HSCAN signal which has one-half the frequency of the high resolution scan signal and is synchronized as shown in FIG. 14. It is also understood by those in the art that the VSCAN signal (used for both lo-res and hi-res signals) is asserted during the scanning of all horizontal lines on a screen (for example 960 consecutive horizontal scans when the hi-res screen has 960 rows) and is not asserted during vertical retracing.

The inputs to the PLA 300 determine the next state and hence the status of the various control signals. The various control signals are shown in FIGS. 3, 12 and 7. Beginning with FIG. 3, the multiplier control signal is applied to line 231 which controls the multiplier 2. The status of the multiplier control signal at line 231 will determine whether the multiplier 2 multiplies the input by 1 or by 2. As shown in FIG. 12, the multiplier 2 is set at multiplication by 2 in state 314; in all other states the multiplier 2 is set at multiplication by 1. The select line on the multiplexer 6 is line 230 which is coupled to receive the multiplexer 6 control which selects between input H and input I of multiplexer 6. As shown in FIG. 12, the multiplexer 6 control selects the H input only during state 312; during states 314 and 316, the multiplexer 6 control selects the I input to the multiplexer 6.

The select line (SL) of the multiplexer 4 is the line 225 which is coupled to receive the multiplexer 4 control signal. The multiplexer 4 control signal selects between input A and input B of the multiplexer 4. Input A is selected for outputting during states 312 and 314 while input B of the multiplexer 4 is selected during state 316, which as noted in FIG. 12, is the third/first pass.

Also as shown in FIG. 3, the intermediate result shift register 5 (IRSR) is controlled by the IRSR control appearing at line 228 which is an input to the AND gate 227. The other input to the AND gate 227 is the input clock signal (ICK). Thus, it can be seen that the intermediate shift register 5 will be clocked only when the IRSR is asserted ("enabled"). When the IRSR 5 is enabled by asserting the IRSR control signal, the intermediate result shift register will clock in values for storage. It can be seen from FIG. 12 that the intermediate result shift register 5 is enabled during states 312, 314 and 316 by asserting the IRSR control line 228. During the wait states (states 310, 311, 313, 315 and 317), the intermediate result shift register 5 is disabled by not asserting the IRSR control signal on line 228. Similarly, the input side of the dual clock shift register 7 is not enabled during these wait states. For purposes of convenience, the status of the other signals (on lines 230, 231 and 225) may be left indeterminate during these wait states because no values are stored in the IRSR 5 during these states since that register 5 is disabled.

As shown in FIG. 7, the input side only to the dual clock shift register 7 is controlled by the combination of the AND gate 235 and two inputs thereto. First input to the AND gate 235 is the input clock signal (ICK) and the other input is the dual clock shift register control signal appearing on line 236. The input clock signal will appear at the node 237 only when the dual clock shift register control signal is asserted on line 236 permitting the input clock signal to appear at node 237. It can be seen from FIG. 8 that the node 237 is applied as one of the inputs to each of the multiplexers in the group of muxes 152. Since there is no interruption of the output clock signal to the dual clock shift register, the output side of the dual clock shift register 7 functions constantly. Of course, if one wanted to disable the output side of the dual clock shift register 7, for whatever reason, the implementation is straight forward and in the same manner as shown for the input side of the dual clock shift register 7. Thus, when the input side of the dual clock shift register is disabled the clock signal ICK will not appear at node 237 and the dual clock shift register will not accept data. FIG. 12 shows that the dual clock shift register is disabled (input side only) during states 312 and 314. During state 316 the input side of the dual clock shift register 7 is enabled by asserting the dual clock shift register control on line 236 to permit the input clock signal (ICK) to appear at node 237. It can be seen from FIG. 12 that during only state 317 the dual clock shift register 7 is reset by asserting the clear signal appearing as an input to the shift register 151 shown in FIGS. 7 and 8.

The multiplexer 10 shown in FIG. 3 may be hard wired to a simple mechanical switch allowing the user to select between the two inputs to the multiplexer 10. Many other ways, known to those in the art, may be utilized to control the multiplexer 10.

The outputs of the PLA 300 are clocked into registers as shown in FIG. 15. The output of the PLA 300 which indicates the next state is clocked into the state register 301. Similarly, at each input clock, the control signal outputs from the PLA 300 are clocked into the output control registers 303. There is a control register, such as a D flip-flop, for each of the control signals. Thus, there is a control signal output register for the signal appearing at lines 231, 230, 225, 228 and 236. There is also a control register for the dual clock shift register clear signal which is also an output from the PLA 300, which is asserted only during state 317.

The PLA 300 during the operation of the video sequence shown in FIG. 12 looks at the state and conditions inputs and determines the next state based on the present state and condition inputs. The next state which is outputted to the state register 301 determines the status of the control signals described above. The control signals as determined pursuant to the next state are outputted to the output control registers 303 making those control signals available to the pixel averaging means. The PLA 300 is implemented using well known programmable logic techniques.

Starting with state 310, it can be seen that the PLA will examine the state register and the condition input registers 302 to determine whether the state is 310 and whether the video scan signal is asserted or not asserted. If the video scan signal is asserted then the next state is equal to 311 and we move down FIG. 12 from state 310 to state 311. If, on the other hand the video scan signal is not asserted during state 310, then the next state is still state 310 causing the PLA 300 to recycle to the beginning of the processing state sequence.

At state 311, the PLA determines the status of the horizontal scan signal. If the horizontal scan signal is not asserted then the next state is still state 311 causing the PLA to recycle back to state 311. If, on the other hand, the horizontal scan signal begins then the PLA sets the next state as state 312, again moving further down FIG. 12's processing sequence diagram. During state 312, the PLA examines the status of the horizontal scan signal. If, during that state, the horizontal scan signal is asserted (indicating that the incoming data is still on the same horizontal scan line) then the control signals are asserted as shown in state 312 of FIG. 12. At each input clock, during state 312, the finite state machine reexamines the status of the horizontal scan signal; if the data is on the same horizontal scan line the horizontal scan signal will still be asserted and the state machine will recycle back to the beginning of state 312 causing the various control signals shown in state 312 of FIG. 12 to be asserted. If, at a particular input clock during state 312, the horizontal scan signal is not asserted then the state machine sets the next state to 313.

At state 313, the state machine executes the same processing required for state 311 except that the next state while on state 313 is of course state 314 and that if the horizontal scan signal is not asserted the next state is the prior state, i.e. state 313. The processing continues in a similar manner as shown in FIG. 14.

If the horizontal scan line starts (which is indicated by the assertion of the horizontal scan signal) then the state machine moves from state 313 to state 314, which is the second pass. During state 314 the second pass scan line is inputted while the various control signals are set as shown in state 314 on FIG. 12. At the end of the second pass (indicated by the fact that the horizontal scan signal is not asserted) then the state machine jumps from state 314 to state 315 which waits for the start of the next horizontal scan. The state machine recirculates during state 315 until the next horizontal scan starts, which is indicated by the assertion of the horizontal scan signal. When that signal is asserted the state machine jumps from state 315 to state 316 which is the processing of the third/first pass. The processing of that pass continues during state 316. As long as the horizontal scan signal is asserted during state 316 the next state is state 316. At the end of that horizontal scan (the third pass) the state machine, at the next input clock, moves to state 317 during which the dual clock shift register 7 is cleared by asserting the clear signal coupled to the shift register 151 as shown in FIGS. 7 and 8. Also during state 317, the finite state machine checks for the end of the vertical scan which is indicated by the fact that the vertical scan signal is not asserted. Therefore, if the vertical scan is asserted during state 317, at the next input clock, the state machine will jump from state 317 to state 313 (i.e. next state is set at state 313) to continue processing of the next horizontal scan line from the high resolution image. If, the vertical scan is not asserted (as during vertical retracing) then the state machine at the next input clock, will recirculate from state 317 to state 310.

The system of the present invention may be used with a display apparatus which uses interlacing (displaying every other line) in the normal manner associated with the NTSC (National Television System Committee) video standard, such as the standard consumer televisions in the United States. Thus, a low resolution monitor which is used with the system of the present invention may use interlacing as in the NTSC standard. If so, all lines of the low resolution image are computed as described above but alternative lines from the low resolution image are simply discarded by not clocking them into the dual clock shift register (by not enabling the input clock signal to reach node 237 as shown in FIGS. 7 and 8). Moreover, in order to discard the low resolution line the clear signal of the dual clock shift registers should not be asserted for every other line. That is, for interlaced low resolution display the dual clock shift register clear signal and the dual clock shift register enable signal are only issued every other line causing alternative output lines of the low resolution image to be discarded.

Figure 5:
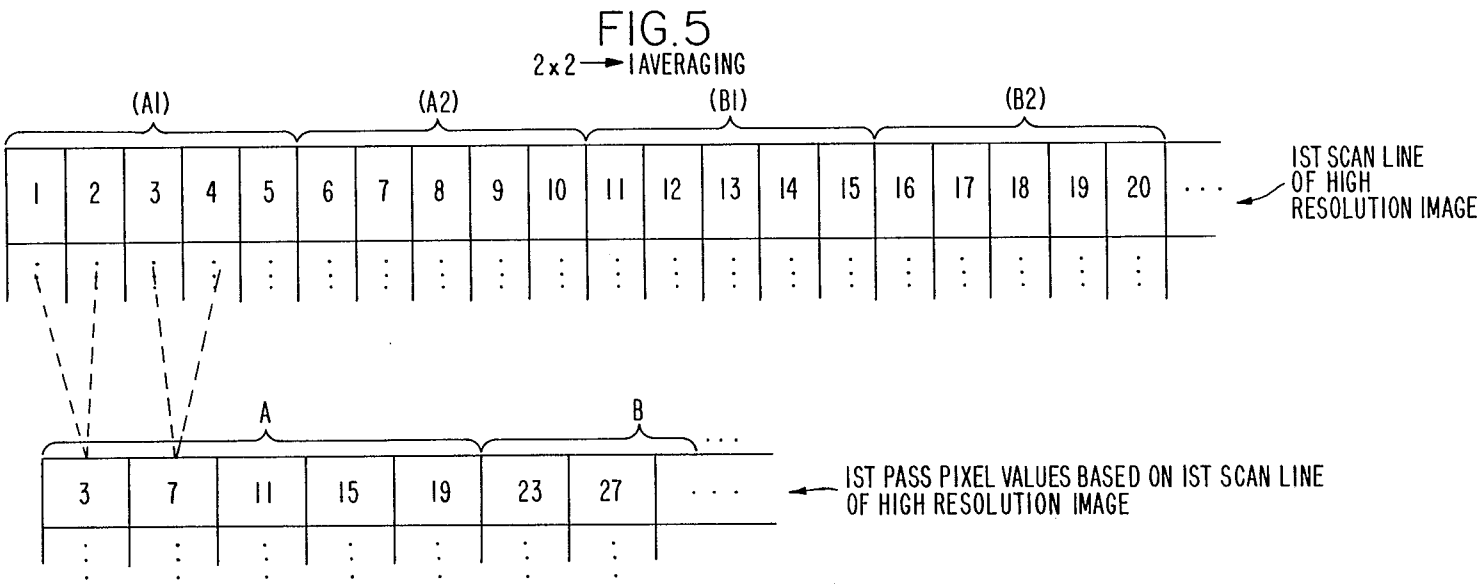
FIG. 5 shows a portion of the first scan line from the higher resolution image and the first pass which is based on the first scan line shown in FIG. 5 in a 2×2 averaging system.
Figure 6:
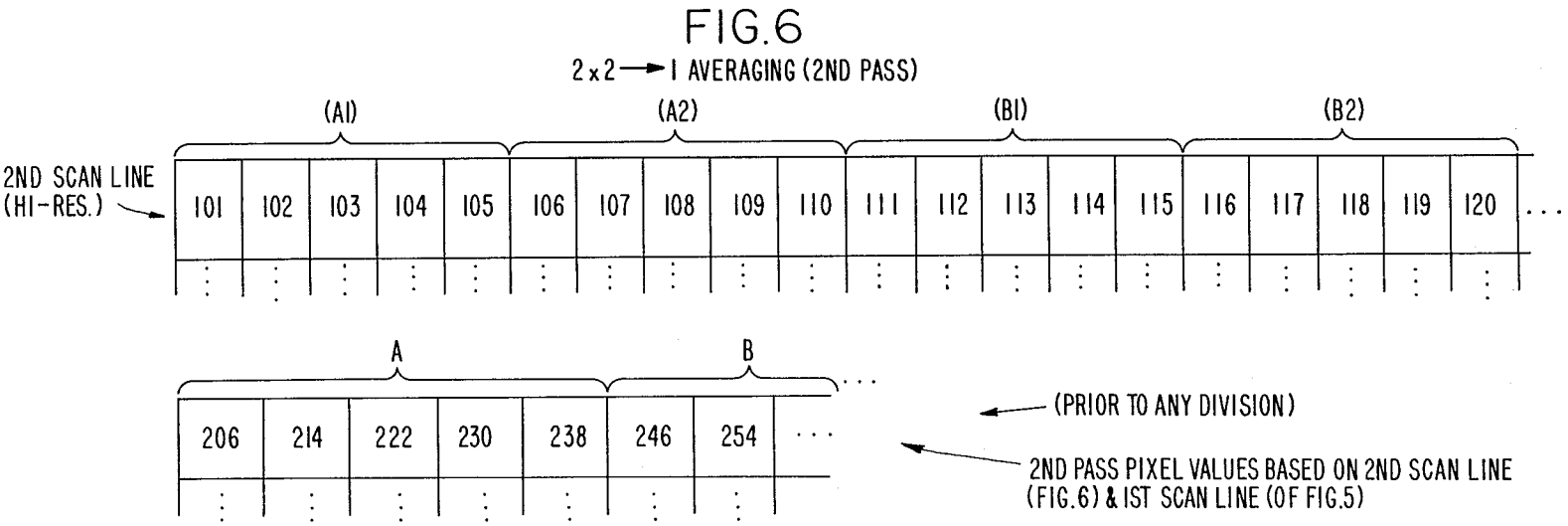
FIG. 6 shows a portion of the second scan line and second pass based thereon in the 2×2 averaging system.

Another embodiment of the invention is illustrated in FIG. 4 and its associated figures, FIGS. 5 and 6. In this embodiment of the invention, a 2×2 group of pixels from a high resolution image is converted to a single pixel for display on a lower resolution image. The 2×2 group of pixels is converted by the system shown in FIG. 4 to a single pixel for display; no overlapping is used in this example of a 2×2 system. The output of this system may then be mapped through a 256×8 gamma correction ROM 80 and the output is provided, through well known video processing circuitry (e.g. DAC—digital-to-analog converter), to a lower resolution display apparatus.

The system of FIG. 4 consists of three sections—an input section, an averaging section and an output section. The system of FIG. 4 operates on the digital pixel values on the high resolution image to produce a simple average that is not weighted. Since four pixels are involved in averaging to a single pixel in a low resolution image the result of the sum of a 2×2 pixel group is divided by four in accordance with the general principals of this invention. In the input section, as shown in FIG. 4, two 5-pixel input latches (input latches A and B) collect an even number (10) of pixels from the 5-pixel wide input bus 56. This input section also includes a pair of 8-bit 5-stage input shift registers (i.e. shift registers 58 and 59). It can be seen that the input section of the pixel averaging means shown in FIG. 4 is substantially similar to the input section of the pixel averaging means shown in FIGS. 3 and 10. Thus, the input latches 54 and 55 of FIG. 4 may be implemented as shown in FIG. 10. Shift register 58 is comprised of five registers, being registers 58*a*, 58*b*, 58*c*, 58*d* and 58*e*; shift register 59 is comprised of register 59*a*, 59*b*, 59*c*, 59*d* and 59*e*. The details of register 59*d* are also shown in FIG. 4*a*. All registers in the shift register 58 and 59, except for 58*e* and 59*e* may be implemented as shown for register 59*d* in FIG. 4*a*. Registers 58*e* and 59*e* may be implemented as shown in FIG. 10 for register 214*b*. As with the input section shown in FIG. 10, the input section of the pixel averaging means shown in FIG. 4 is controlled by four control signals which are the input clock (ICK), the two latch control signals (ILA and ILB) used for the input latches 54 and 55 and the input shift register (SR) load enable signal which is coupled to the select line of the muxes contained in each of the registers in the shift registers 58 and 59. These control signals are shown by way of example in FIG. 13.

In the averaging section of the 2×2 pixel averaging means shown in FIG. 4, a three input 9-bit adder 60, a divider 62 and a pair of 640×9 scan line buffers 69 and 70 combine to perform the averaging on pairs of input high resolution scan lines. FIG. 5 shows a first input scan line from the high resolution image and FIG. 6 shows a second input scan line from the high resolution image; immediately below each of those lines in their respective figure is a line representing the running sum pixel values based on their respective high resolution lines which is calculated by the pixel averaging means shown in FIG. 4.

In the output section a multiplexer 71, which is a 2 to 1 multiplexer selects between line buffers 69 and 70 for outputting to the low resolution display apparatus. It can be seen that a division by 2 takes place on line 73 by taking only the eight most significant bits from the selected input. This division by 2 in combination with the division by 2 during a second pass which is accomplished by the divider 62, produces the simple, unweighted average of 2×2 pixels from the high resolution image.

The line buffer 69 and 70 are effectively swapped by the multiplexer 71 and 72 such that while one line buffer serves as an intermediate result memory means the other line buffer is outputting, according to the output clock rate (which has a frequency rate which is equal to one-half of the frequency rate of the input clock—where the hi-res and lo-res images are both non-interlaced). Thus, while two lines are being processed by, for example line buffer (LB) 69 the preceeding low resolution line is being outputted by line buffer 70 at the output clock (OCK) rate. It can be seen that it takes the line buffer, which is being used as the output source, two passes to output data since the output clock is one-half the frequency of the input clock.

Figure 16:
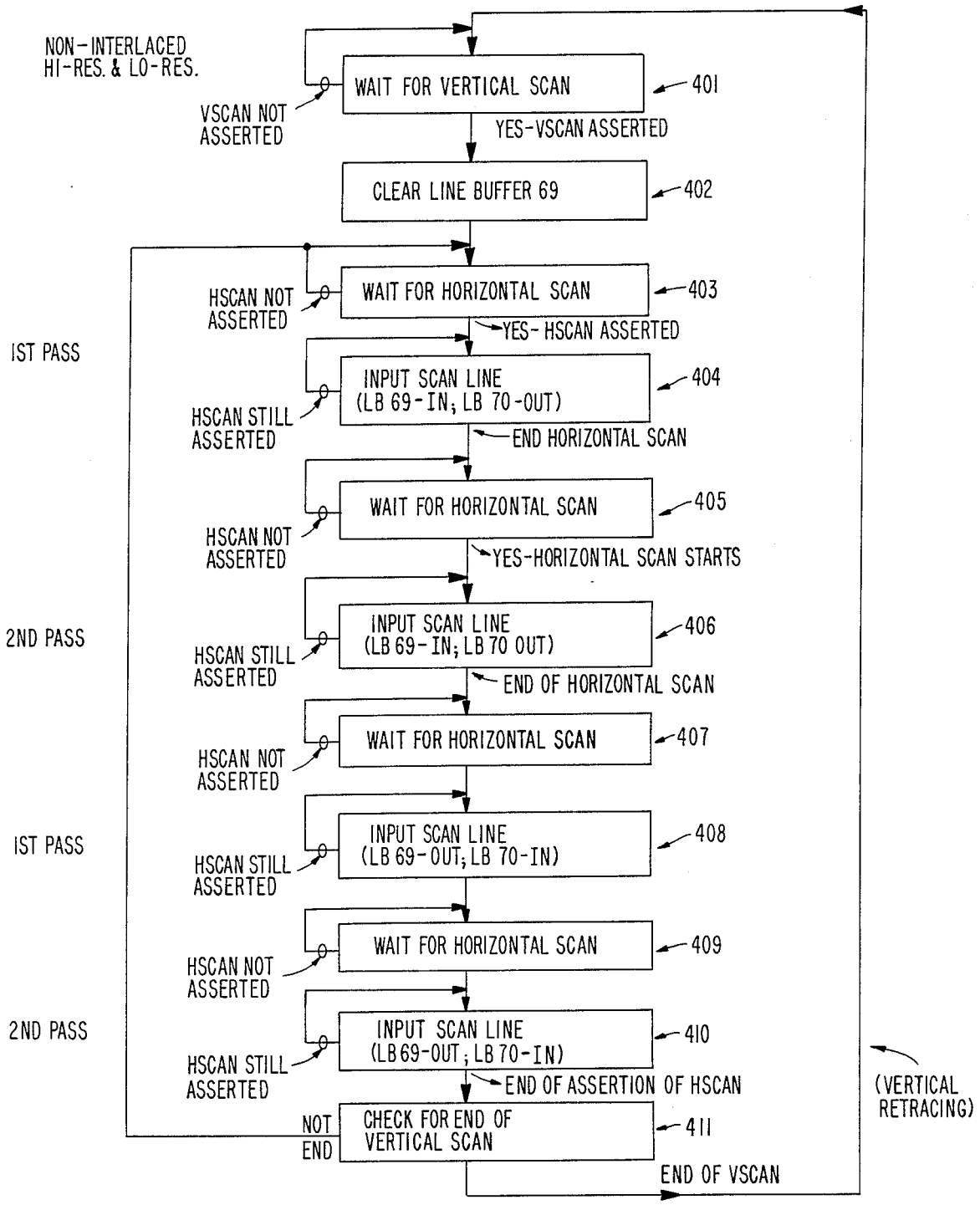
FIG. 16 shows an example of a flow chart for a finite state machine for controlling the operation of the system shown in FIG. 4.

The averaging process of the pixel averaging means shown in FIG. 4 will be described with references to FIGS. 4 and 16. FIG. 16 shows the state machine processing sequence used by a finite state machine which provides the control signals for the pixel averaging means shown in FIG. 4. The averaging process begins with the finite state machine waiting for a vertical scan signal. As described above, the finite state machine is implemented in a programmable logic array (PLA) such as that shown in FIG. 15. The state machine has condition registers and a state register and has outputs which output the next state and the control signals used to control the pixel averaging means shown in FIG. 4. The state machine is in state 401 (FIG. 16) while it waits for the vertical scan (VSCAN) signal to be asserted. The state machine continues to recycle remaining in state 401 for each input clock until the vertical scan signal is asserted. When the vertical scan signal is asserted, a new screen will be scanned and the state machine jumps from state 401 to state 402 (i.e. sets next state=402). During state 402 the line buffer 69 is cleared to all zeros by asserting the clear signal on line 423 which is coupled to the clear inputs of each of the registers within the line buffer 69. The line buffers 69 and 70 are preferrably shift registers having 640 stages (registers) with each stage holding 9 bits. Following state 402, at the next input clock, the state machine jumps to state 403 during which it waits for a horizontal scan to start, which is indicated by the assertion of the horizontal scan (HSCAN) signal. When the HSCAN signal is asserted, the state machine jumps from state 403 to state 404 during which it asserts controls allowing the inputting of the scan line which is the first pass. During this first pass the line buffer 69 will serve as the "input" buffer in that it will serve to store the intermediate results and the final results on the low resolution line being processed. At the same time the line buffer 70 will be selected for outputting by the multiplexer 71; the select line 436 which is coupled to the MUX 71 selects for outputting between the outputs of line buffer 69 and line buffer 70. Thus, during state 404 the MUX 71 selects the line buffer 70 so that at each output clock the low resolution pixel values leave line buffer 70, pass through the multiplexer 71, are divided by 2 at line 73 and then are corrected in the gamma correction ROM 80. At the same time (state 404) the MUX 65 is preparing the line buffer 70 by introducing zeros through line 430 into the line buffer 70; the zeros will be used during the next first pass when the line buffer 70 becomes the intermediate result memory means. The zeros are necessary during the first pass so that the 9-bit input to the adder 60 will have zeros during the first pass.

The following table shows the status of the various control signals during each of the states shown in FIG. 16. It is understood that the finite state machine in this embodiment operates as described with respect to FIG. 15 above. Thus, at each input clock, the finite state machine checks the condition inputs and the state register to determine the next state and based on the next state also outputs the various control signals as shown in Table 1.

TABLE 1

| State | Status of Control Signals |
|---|---|
| 401 | LB Control (426)-NOT asserted |
| | Clear (423)-NOT asserted |
| | MUX 64 (line 420) - |
| | MUX 65 (line 421) - |
| | MUX 71 (select 436) - Does |
| | MUX 72 (select 435) - NOT |
| | MUX 424 (select 425) - Matter |
| | MUX 433 (select 434) - |
| | Divider Control (422) - |
| 402 | Clear (423)-Asserted |
| | LB Control (426)-NOT asserted |
| | all others - Does NOT matter |
| 403 | LB Control (426)-NOT asserted |
| | Clear (423)-NOT asserted |
| | all others - Does NOT matter |
| 404 | LB Control (426)-Asserted |
| | Clear (423)-NOT Asserted |
| | MUX 64 (line 420)-Divider 62 output |
| | MUX 65 (line 421)-'0's (on line 430) |
| | MUX 71 (line 436)-Line Buffer 70 |
| | MUX 72 (line 435)-Line Buffer 69 |
| | MUX 424 (select 425)-ICK selected |
| | MUX 433 (select 434)-OCK selected |
| | Divider Control (422)-Divide by 1 |
| 405 | LB Control (426)-NOT asserted |
| | Clear (423)-NOT asserted |
| | all others - Does NOT matter |
| 406 | LB Control (426)-Asserted |
| | Clear (423)-NOT asserted |
| | MUX 64 (line 420)-Divider 62 output |
| | MUX 65 (line 421)-'0's (on line 430) |
| | MUX 71 (line 436)-Line Buffer 70 |
| | MUX 72 (line 435)-Line Buffer 69 |
| | MUX 424 (select 425)-ICK selected |
| | MUX 433 (select 434)-OCK selected |
| | Divider Control (422)-Divide by 2 |
| 407 | LB Control (426)-NOT Asserted |
| | Clear (423)-NOT Asserted |

TABLE 1-continued

| State | Status of Control Signals |
|---|---|
| | all others - Does NOT matter |
| 408 | LB Control (426)-Asserted |
| | Clear (423)-NOT Asserted |
| | MUX 64 (line 420)-'0's (on line 429) |
| | MUX 65 (line 421)-Divider 62 output |
| | MUX 71 (line 436)-Line Buffer 69 |
| | MUX 72 (line 435)-Line Buffer 70 |
| | MUX 424 (select 425)-OCK selected |
| | MUX 433 (select 434)-ICK selected |
| | Divider Control (422)-Divide by 1 |
| 409 | LB Control (426)-NOT Asserted |
| | Clear (423)-NOT Asserted |
| | all others - Does NOT matter |
| 410 | LB Control (426)-Asserted |
| | Clear (423)-NOT Asserted |
| | MUX 64 (line 420)-'0's (on line 429) |
| | MUX 65 (line 421)-Divider 62 output |
| | MUX 71 (line 436)-Line Buffer 69 |
| | MUX 72 (line 435)-Line Buffer 70 |
| | MUX 424 (select 425)-OCK selected |
| | MUX 433 (select 434)-ICK selected |
| | Divider Control (422)-Divide by 2 |
| 411 | LB Control (426)-NOT Asserted |
| | Clear (423)-NOT Asserted |
| | all others - Does NOT matter |

As the first scan line is inputted during state 404, which is a first pass, pairs of adjacent pixels in the high resolution scan line are added together and stored in the buffer 69. Thus, summations are inputted to line buffer 69 during the first pass and, also during the first pass, the zeros from the clear operation in state 402 are leaving the line buffer 69 and entering the three input adder 60 through the multiplexer 72 which has been set (via the select line 435) to route the output from line buffer 69 back to the adder 60. Since the line buffer 69 is serving as the intermediate result storage mechanism, the multiplexer 424 provides the input clock, during this first pass, to the clock input of the registers in the line buffer 69. Hence, during state 404 the output of the multiplexer 424 provides the input clock signal through the AND gate 427; the input clock signal appears because the line buffer control (LBCONTROL) at line 426 has been asserted permitting both clock signals to appear at the multiplexer 424. The AND gate 428 serves a similar function as the AND gate 427. Thus, the multiplexer 424 selects between the output and input clock signals when those signals are permitted to reach the multiplexer 424 by the LBCONTROL (when asserted). It can be seen that the multiplexer 433 performs a similar function allowing the clock input to the line buffer 70 to be connected to either the input clock or the output clock depending on the status of the select line 434 which selects the inputs to the MUX 433. The line buffer control (LBCONTROL) 426 controls whether or not the two clock signals are routed to the MUX 433. That is, when the LBCONTROL 426 is asserted the AND gate 431 and the AND gate 432 will allow the two clock signals to appear at the inputs to the multiplexer 433. The line buffer control 426 has the same effect with respect to AND gates 427 and 428. Thus, when the LBCONTROL 426 is not asserted the input and output clock signals do not appear at the inputs to the MUX 424 and similarly do not appear at the inputs to the MUX 433.

At the end of the first pass which occurs during state 404, the line buffer 69 will be completely filled with 640 summations which constitute the first pass values shown, for example, in FIG. 5 (second part). At the same time, the line buffer 70 will have shifted 320 zeros into the line buffer and have shifted out 320 values of the preceeding low resolution scan line. The first pass values are unaffected by the divider 62 since that divider divides by 1 on the first pass; the divider 62 is under the control of the divider control signal appearing at line 422.

At the end of the first pass, the horizontal scan signal will not be asserted causing the finite state machine to jump from state 404 to state 405 during which it waits for the next horizontal scan. The state machine cycles through various input clock signals until the next horizontal scan signal is asserted indicating the start of the next horizontal scan line. When that occurs the state machine jumps from state 405 to state 406 which is a second pass.

As the second high resolution scan line is inputted during this second pass, adjacent pixels are once again added but this time the first pass pixel sum values from the line buffer 69 are also added in via the recirculation route through the multiplexer 72 which is selected, via the select line 435, to output values from the output of the line buffer 69 to the adder 60. Also during this second pass the multiplexer 64 is still selected to transmit the result from the divider 62 to the line buffer 69 (the multiplexer 64 is controlled by the select line 420 as shown in Table 1). During this second pass the divider 62 divides by 2; this division by 2-and the subsequent division via line 73 (at the output of multiplexer 71) will cause the summation of the four pixel values to be divided by 4 thereby producing a simple, unweighted average of four pixels. The 10-bit result from the adder 60 during the second pass may be divided by 2 by shifting the binary decimal point in the divider 62 as is well known in the art.

At the end of this second pass the line buffer 69 will be completely filled with the pixel values for the low resolution image. At the same time the line buffer 70 will have been filled with zeros via line 430 which is inputted to the MUX 65. Thus, the line buffer 70 will be ready to be swapped with the line buffer 69 which will occur at the start of the next pass. When the horizontal scan line ends, the horizontal scan signal will no longer be asserted and the state machine will jump from state 406 to state 407 during which it waits for the assertion of the next horizontal scan signal (HSCAN). When that signal is asserted, indicating the start of the next scan line, the state machine jumps from state 407 to state 408 which is the next first pass. During this first pass and the next pass the line buffer 69 will be outputting the low resolution averaged line and the line buffer 70 will serve to store the intermediate results and final results being computed during states 408 and 410.

It can be seen that the line buffers 69 and 70 swapped roles during the operation of the pixel averaging means shown in FIG. 4. Specifically, during state 408 the MUX 71 has selected the line buffer 69 for outputting the lower resolution display apparatus. The MUX 72 has selected the line buffer 70 for recirculation to the adder 60. The multiplexer 424 will select (when the LBCONTROL is asserted) the output clock signal to clock the line buffer 69. The line buffer 70 will now be under control of the input clock as the MUX 433 will select the input clock (through AND gate 431). The MUX 65 will cause the output of the divider 62 to pass to the line buffer 70. The MUX 64 will input zeros throught line 429 into the line buffer 69 at the output clock rate.

At the end of this first pass (state 408) the line buffer 70 will be completely filled with first pass values. At the same time, the line buffer 69 will have 320 zeros filling the first half of that line buffer and will have 320 low resolution pixel values filling the last half of that buffer. Also at the end of state 408 the horizontal scan signal is no longer asserted causing the state machine to jump from state 408 to state 409 during which it waits for the next horizontal scan.

At the beginning of the next horizontal scan, indicated by the assertion of the HSCAN signal, the state machine jumps from state 409 to state 410. During state 410 the line buffer 69 is completely emptied of the low resolution pixel values and is filled with zeros for the processing of the next line. Also during state 410, the line buffer 70 recirculates the first pass values (state 408) back to the adder 60 and at the same time receives the new low resolution values through the multiplexer 65. At the end of state 410, indicated by the end of the assertion of the HSCAN signal, the state machine will jump from state 410 to state 411 during which is checks for the end of the vertical scan. If the vertical scan signal is still asserted, indicating the continuation of the vertical scan, the state machine jumps from state 411 to state 403. If, on the other hand, the VSCAN signal is no longer asserted the state machine jumps from state 411 back to the beginning at state 401. The end of the vertical scan signal indicates a vertical retracing is occurring during which the electron beam(s) is (are) scanned from the bottom of the screen back to the top.

While the invention has been described with reference to specific embodiments, it will be apparent to one with ordinary skill in the art to make various modifications which are within the scope and spirit of the invention as defined by the following claims.

I claim:

1. A dual clock shift register comprising:

a first shift register having a first register and a second register, said first and said second registers each for storing one of two logical states comprising a first logical state and a second logical state and each of said first and said second registers having an output and a clock signal input, said clock signal inputs being coupled to receive a second clock rate, said output of said first register being coupled to an input of said second register, said first register having a data input coupled to a signal set at said first logical state, and said first register and said second register having a clear signal input for receiving a clear signal to store said second logical state in said first and said second registers;

a pair of multiplexers comprising a first multiplexer and a second multiplexer, said first and said second multiplexer each having a first multiplexer input and a second multiplexer input, said first multiplexer input for receiving a signal corresponding to a first clock rate and said second multiplexer input for receiving a signal corresponding to said second clock rate, each of said first and said second multiplexers having a select line, the select line of said first multiplexer being coupled to the output of said first register and the select line of said second multiplexer being coupled to the output of said second register, said first multiplexer having an output and said second multiplexer having an output, wherein the output of said first multiplexer depends on the logical value on said select line of said first multiplexer and the output of said second multiplexer depends on the logical value on said select line of said second multiplexer, the output of said first multiplexer being one of the signal corresponding to the first clock rate and the signal corresponding to the second clock rate;

a second shift register having a third register and a fourth register, said third register having a first clock input, said fourth register having a second clock input, said first clock input being coupled to the output of said first multiplexer, said second clock input being coupled to the output of said second multiplexer, said third register having an input and an output, said fourth register having an input and an output, said output of said third register being coupled to said input of said fourth register, wherein the logical state of the output of said first register determines the state of the first clock input of said third register and the logical state of the output of said second register determines the state of the second clock input of said fourth register, whereby said third register may be clocked at a different rate than said fourth register.

2. A dual clock shift register as in claim 1 wherein said dual clock shift register is coupled to a system for converting a high resolution image for a computer screen to a lower resolution image for display on a lower resolution display apparatus, wherein said dual clock shift register is used in said system for storing pixel values.

3. A dual clock shift register as in claim 2 wherein said dual clock shift register is used for storing pixel values of said lower resolution image.

4. A dual clock shift register as in claim 2 wherein said dual clock shift register is coupled to said lower resolution display apparatus.

5. A dual clock shift register as in claim 2 wherein said first clock rate is the clock rate for input sampling of pixel values from said high resolution image and said second clock rate is for the output rate of pixel values to said lower resolution display apparatus.

6. A dual clock shift register for use in a computer display system for converting a high resolution image for a computer screen to a lower resolution image for display on a lower resolution display apparatus, said computer display system having a first clock rate for inputting data to said computer display system and a second clock rate for outputting data from said computer display system, said dual clock shift register comprising:

a first shift register having n registers each for storing one of two logical states comprising a first logical state and a second logical state, each of said n registers having an output, said first shift register having a data input and a clock signal input, said clock signal input being coupled to receive said second clock rate, said data input being coupled to a signal set at said first logical state and said first shift register having a clear signal input for receiving a clear signal to set all n registers to said second logical state;

n multiplexers each being associated with a corresponding one of said n registers and having a select line coupled to the output of the corresponding one of said n registers of said first shift register, said n multiplexers each having a first multiplexer input and a second multiplexer input, said first multiplexer input for receiving a signal corresponding to said first clock rate and said second multiplexer input for receiving a signal corresponding to said second clock rate, each of said n multiplexers having an output and being associated with a corresponding one of said n registers of said first shift registers such that the output of one of said n registers of said first shift register is coupled to the select line of the corresponding multiplexer, the logical value on said select line determining the output of said corresponding multiplexer, said output of said corresponding multiplexer being one of the signal corresponding to the first clock rate and the signal corresponding to the second clock rate;

a second shift register having m registers, where m=n, each of said m registers being associated with a corresponding one of said n multiplexers, said m registers of said second shift register each having a clock input, each of said clock inputs of said m registers of said second shift register being coupled to a corresponding one of the outputs of said n multiplexers, whereby said second shift register can be clocked at two different clock rates.

* * * * *